US011864600B1

(12) United States Patent
Burnsed, Jr. et al.

(10) Patent No.: US 11,864,600 B1
(45) **Date of Patent: *Jan. 9, 2024**

(54) UTILITY GARMENT

(71) Applicant: Blue Force Gear, Inc., Pooler, GA (US)

(72) Inventors: Ashley A. Burnsed, Jr., Port Wentworth, GA (US); Stephen G. Hilliard, Charleston, SC (US)

(73) Assignee: Blue Force Gear, Inc., Pooler, GA (US)

( * ) Notice: Subject to any disclaimer, the term of this patent is extended or adjusted under 35 U.S.C. 154(b) by 116 days.

This patent is subject to a terminal disclaimer.

(21) Appl. No.: 17/120,187

(22) Filed: Dec. 13, 2020

Related U.S. Application Data

(63) Continuation of application No. 15/714,156, filed on Sep. 25, 2017, now Pat. No. 10,893,708, which is a continuation-in-part of application No. 14/059,417, filed on Oct. 21, 2013, now abandoned.

(60) Provisional application No. 62/399,717, filed on Sep. 26, 2016.

(51) Int. Cl.
*A41D 13/00* (2006.01)
*F41H 1/02* (2006.01)
*A41D 1/04* (2006.01)

(52) U.S. Cl.
CPC ..... *A41D 13/0002* (2013.01); *A41D 1/04* (2013.01); *F41H 1/02* (2013.01); *A41D 2400/70* (2013.01)

(58) Field of Classification Search
CPC .. A41D 13/0002; A41D 2400/70; A41D 1/04; F41H 1/02
See application file for complete search history.

(56) References Cited

U.S. PATENT DOCUMENTS 6,170,130 B1 * 1/2001 Hamilton ..... A45F 3/04 24/130
6,769,137 B2 8/2004 D'Annunzio
6,948,188 B2 9/2005 D'Annunzio
7,020,897 B2 4/2006 Johnson
7,047,570 B2 5/2006 Johnson
7,243,376 B2 7/2007 Johnson
(Continued)

OTHER PUBLICATIONS http://en.wikipedia.org/wiki/Modular_Tactical_Vest.
(Continued)

*Primary Examiner* — Nathan E Durham
*Assistant Examiner* — Abby M Spatz
(74) *Attorney, Agent, or Firm* — Merchant & Gould P.C.

(57) ABSTRACT

A utility garment has a front garment portion adapted for positioning at a wearer's chest, a rear garment portion adapted for positioning at a wearer's back, the front portion and rear portion being removably detachable at a plurality of attachment facilities, each attachment facility including a front facility portion connected to the front garment portion and a rear facility portion connected to the rear garment portion, at least a first one of the front facility portion and the rear facility portion comprising first and second bodies, the first body defining a first cable passage and the second body defining a second cable passage, the first cable passage and the second cable passage being registered with each other and adapted to receive a single cable, and the first body and second body being spaced apart from each other to define a latch receptacle space.

19 Claims, 25 Drawing Sheets

(56) References Cited

U.S. PATENT DOCUMENTS

| | | | | |
|---|---|---|---|---|
| 8,196,273 | B2 | 6/2012 | Anscher | |
| 8,201,271 | B2 | 6/2012 | Dennis | |
| 8,370,962 | B2 | 2/2013 | McBride | |
| 8,418,265 | B1 | 4/2013 | Storms, Jr. | |
| 2007/0107109 | A1 | 5/2007 | Johnson | |
| 2012/0318837 | A1* | 12/2012 | Yaeger | A45F 3/08 224/665 |

OTHER PUBLICATIONS http://history.amedd.army.mil/booksdocs/wwii/woundblstcs/chapter11figure320.jpg.
http://www.blackhawk.com/catalog/Cutaway,69.htm.
http://www.tacticaltailor.com/releasablearmorcarrierttrac.aspx.
http://www.cryeprecision.com/P-ARMC4902LG0/Cage-Armor-Chassis%e2%84%a2.

* cited by examiner

UTILITY GARMENT

CROSS-REFERENCE TO RELATED APPLICATION

This is a Continuation of U.S. patent application Ser. No. 15/714,156, entitled "UTILITY GARMENT," filed Sep. 25, 2017, which is a Continuation-in-Part of U.S. patent application Ser. No. 14/059,417 filed on Oct. 21, 2013, entitled "UTILITY GARMENT," which are hereby incorporated by reference in their entirety for all that is taught and disclosed therein.

U.S. patent application Ser. No. 15/714,156, entitled "UTILITY GARMENT," filed Sep. 25, 2017 also claims the benefit of U.S. Provisional Patent Application No. 62/399,717 filed on Sep. 26, 2016, entitled "RELEASABLE PLATE CARRIER," which is hereby incorporated by reference in its entirety for all that is taught and disclosed therein.

FIELD OF THE INVENTION

The present invention relates to body armor, and more particularly to a utility garment that can be easily reassembled after the quick-release cable is removed.

BACKGROUND OF THE INVENTION

Utility garments are loadbearing garments desirable for protecting law enforcement and military personnel from projectiles fired from firearms and from shrapnel from explosions. Utility garments are worn on the torso, and are used with metal or ceramic plates to provide additional protection from rifle rounds as well as resistance to stab and/attacks from knives and bayonets. Utility garments may also include shoulder and side protection armor components.

Although utility garments provide obvious advantages to the wearer, conventional approaches have also suffered from significant disadvantages. The Modular Tactical Vest currently used by both the United States Marine Corps and the Navy weighs 30 pounds. This considerable weight makes it essential that the vest be easily removable in an emergency situation, such as when personnel are unexpectedly introduced into a body of water in an aviation crash or overboard incident. It is also critical that the vest provide a means for quick removal to enable medical personnel access an injured wearer's body, especially without requiring unwanted jostling or shifting of the patient.

The current Modular Tactical Vest employs a quick-release system to enable rapid removal of the vest in an emergency. The front and back of the vest are effectively "knitted" together by a single aircraft cable that provides a hinge pin to connect the shoulders and sides, each of which includes what are analogous to hinge plates, with passages for the cable "pin". To release the vest quickly, the aircraft cable is pulled upward out of the passages, which enables the front and back of the vest to pop apart. Although the quick-release system is generally effective, the front and back of the vest must be carefully aligned for the cable to be reinserted to reassemble the vest.

Reassembly is a very difficult process requiring skill and dexterity, somewhat analogous to repacking a parachute. The time and trouble to reassemble the vest makes wearers reluctant to practice the emergency exit process prior to an emergency. Without frequent repeated practice with equipment and procedures, wearers lack natural muscle memory of the quick-release action when faced with an actual emergency, which could interfere with egress. There is also a danger of reassembling the vest improperly, which could result in the vest accidentally falling off in the middle of battle or other strenuous conditions.

Therefore, a need exists for a new and improved utility garment that can be easily reassembled after the quick-release cable is removed. In this regard, the various embodiments of the present invention substantially fulfill at least some of these needs. In this respect, the utility garment according to the present invention substantially departs from the conventional concepts and designs of the prior art, and in doing so provides an apparatus primarily developed for the purpose of enabling easy reassembly after the quick-release cable is removed.

SUMMARY OF THE INVENTION

The present invention provides an improved utility garment, and overcomes the above-mentioned disadvantages and drawbacks of the prior art. As such, the general purpose of the present invention, which will be described subsequently in greater detail, is to provide an improved utility garment that has all the advantages of the prior art mentioned above.

To attain this, the preferred embodiment of the present invention essentially comprises a front garment portion adapted for positioning at a wearer's chest, a rear garment portion adapted for positioning at a wearer's back, the front portion and rear portion being removably detachable at a plurality of attachment facilities, each attachment facility including a front facility portion connected to the front garment portion and a rear facility portion connected to the rear garment portion, at least a first one of the front facility portion and the rear facility portion comprising first and second bodies, the first body defining a first cable passage and the second body defining a second cable passage, the first cable passage and the second cable passage being registered with each other and adapted to receive a single cable, the first body and second body being spaced apart from each other to define a latch receptacle space, the first body and second body having opposed end surfaces facing the latch receptacle space, a base element connected between the bodies and spaced apart from a cable path defined by a location of a cable received in the first and second passages, at least a second one of the front facility portion and the rear facility portion comprising a latch element adapted to be removably received in the latch receptacle space, the latch element having a flexible retention element having an unflexed condition and a flexed condition, the retention element adapted to contact at least one of the bodies to prevent extraction of the latch element from the latch receptacle when a cable occupies the first and second passages and the retention element is in the unflexed condition, the retention element adapted to bypass the at least one of the bodies to enable extraction of the latch element from the latch receptacle when a cable occupies the first and second passages and the retention element is in the flexed condition, and the retention element adapted to bypass the at least one of the bodies to enable extraction of the latch element from the latch receptacle when the first and second passages are free of a cable and the retention element is in the unflexed condition. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
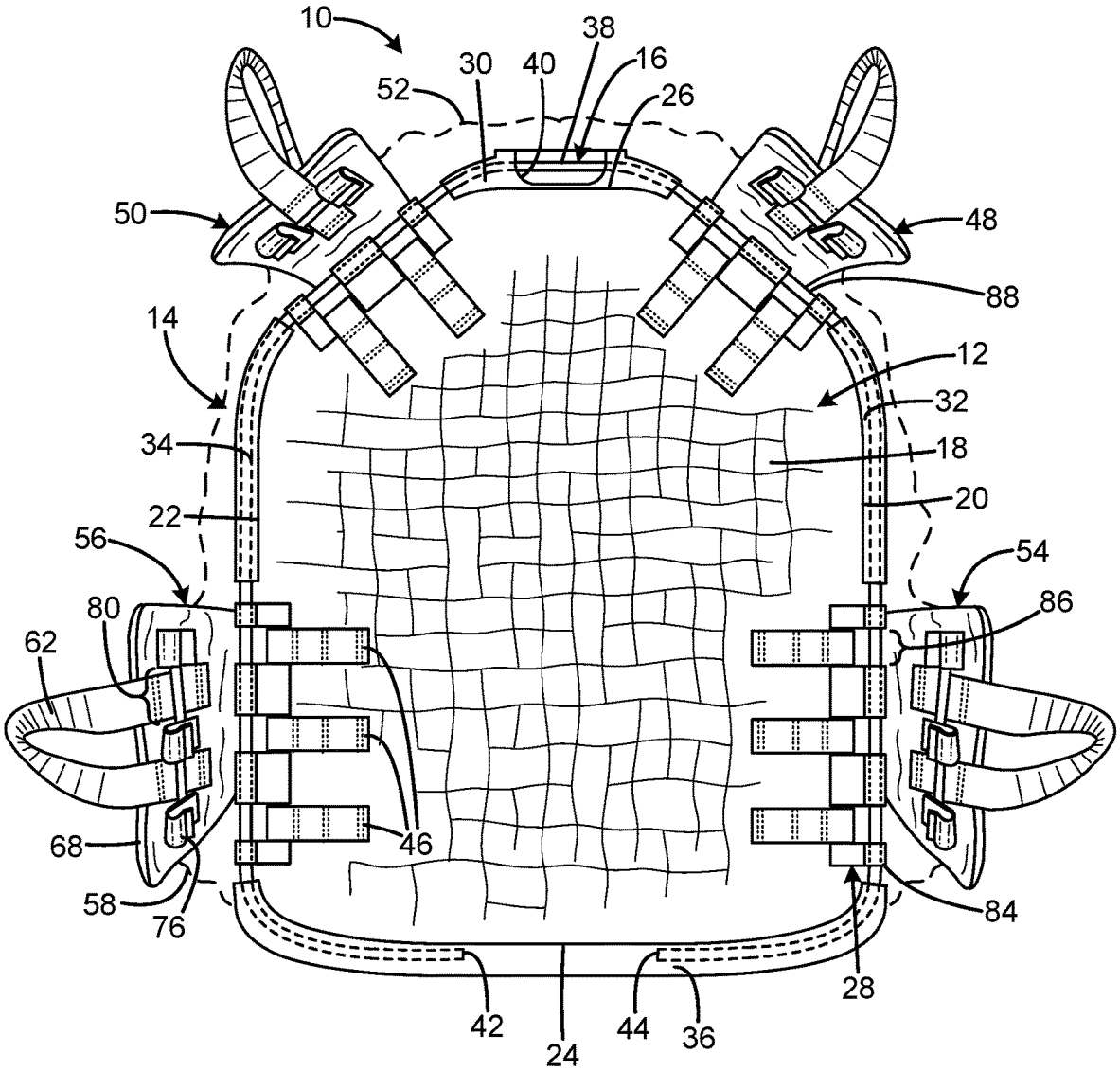
FIG. 1 is a front view of the current embodiment of the utility garment constructed in accordance with the principles of the present invention.

An embodiment of the utility garment of the present invention is shown and generally designated by the reference numeral 10.

FIG. 1 illustrates the improved utility garment 10 of the present invention. More particularly, the utility garment is a loadbearing armor plate carrier vest that has a front plate carrier 12 and a rear plate carrier 14 that are removably detachable at a plurality of attachment facilities. The front plate carrier has a front 18, left side 20, right side 22, bottom 24, and top 26 (oriented from the perspective of the operator). Four cable retainers 28 are connected to the sides of the front plate carrier by securing straps 46 with two cable retainers on either side of the top and two at the bottom of the left and right sides. A cable pocket 30 is attached to the top of the front plate carrier and extends between the two upper cable retainers. A cable pocket 32 is attached to the left side of the front plate carrier and extends between the upper cable retainer on the left side and the lower cable retainer on the left side. A cable pocket 34 is attached to the right side of the front plate carrier and extends between the upper cable retainer on the right side and the lower cable retainer on the right side. A cable pocket 36 is attached to the bottom of the front plate carrier and extends between the lower cable retainer on the left side and the lower cable retainer on the right side. In the current embodiment, the securing straps for the cable retainers and the cable pockets are sewn onto the front plate carrier. Alternatively, the securing straps and cable pockets could be attached to the front plate carrier by hook and loop fasteners.

An elongated quick-release cable 16 is positioned around the perimeter of the front plate carrier 12 such that the midpoint 38 of the cable is received within the top cable pocket 30. The top cable pocket 30 defines an aperture 40 sized to expose and permit easy access to the midpoint of the cable. The opposed ends 42, 44 of the cable are threaded down the left side 20 and right side 22 of the front plate carrier. The opposed ends are threaded through the cable retainers 28 and the cable pockets 32, 34 and are received within the cable pocket 36 at the bottom of the front plate carrier.

The threading of the quick-release cable 16 around the perimeter of the front plate carrier 12 can be accomplished without any interaction with the rear plate carrier 14, which makes the threading process much easier compared with that of the prior art Modular Tactical Vest described previously. The prior art Modular Tactical Vest requires both the front plate carrier and the rear plate carrier to be precisely aligned during the cable threading process. This feature of the current invention makes routine operator practice to develop muscle memory for the emergency quick-release procedure practical and also greatly reduces the risk that the utility garment 10 will be reassembled incorrectly.

The rear plate carrier 14 forms a left shoulder portion 48 and a right shoulder portion 50 on either side of the top 52. The rear plate carrier also forms a left cummerbund 54 and right cummerbund 56 on either side of the bottom 58. Each of the shoulder portions and cummerbunds has an attached hooking device 60. In the current embodiment, the hooking devices are attached by handle straps 62 that are threaded through the hooking devices and sewn onto the rear plate carrier. The hooking devices on the shoulder portions and cummerbunds are each positioned such that they align with a corresponding cable retainer 28 on the front plate carrier 12 when the utility garment 10 is donned.

Figure 2:
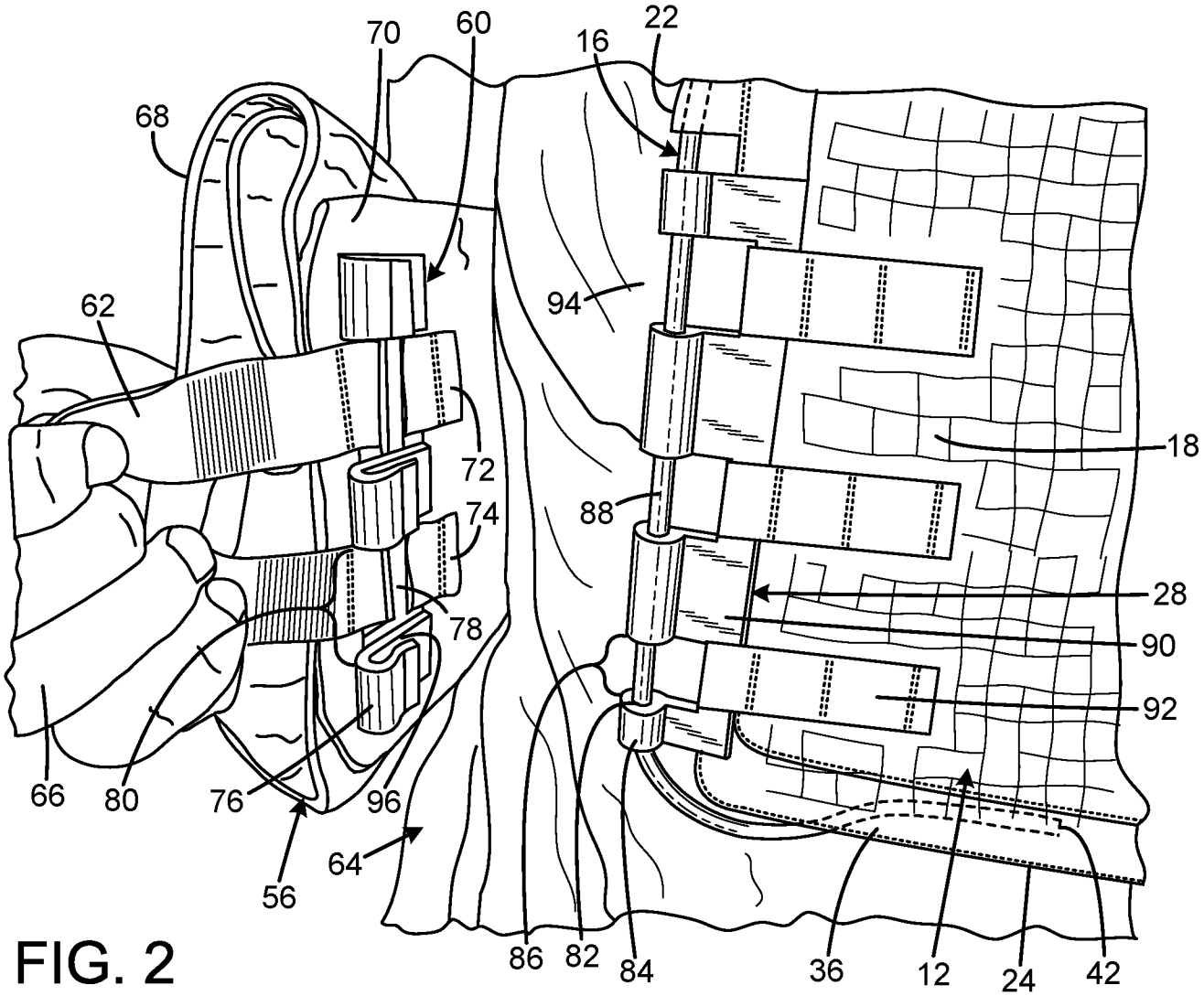
FIG. 2 is an enlarged front view of the current embodiment of the right cummerbund and cable retainer of FIG. 1 in the detached condition.

FIG. 2 illustrates the improved right cummerbund 56 and the cable retainer 28 on the bottom 24 of the right side 22 of the front plate carrier 12 of the present invention. More particularly, the right cummerbund is shown in the detached position with the operator 64 in the process of donning the utility garment 10 to cover the torso. The operator's right hand 66 grasps the handle strap 62 that protrudes from the front 68 of the right cummerbund. The hooking device 60 is attached to the back 70 of the right cummerbund by the opposed ends 72, 74 of the handle strap. The opposed ends of the handle strap are threaded under the center bar 78 and sewn onto the back of the right cummerbund on either side of the hooking device. The hooking device has a series of hooks 76 that are attached to the center bar 78 and separated by gaps 80. Each hook defines a laterally-open passage or gap 96 that tapers from a portion that is wider than the diameter of the quick-release cable 16 to a portion that is slightly narrower than the diameter of the quick-release cable. The hook is sufficiently flexible and resilient to snap over and releasably retain the cable, but with sufficient resistance that the hook resists removal from the cable and will not inadvertently permit the cable to escape the laterally-open passage. In the current embodiment the hooking device is made of plastic.

The quick-release cable 16 is shown threaded through apertures 82 in a series of cable retention portions 84 that are held together by bars 90 to form the cable retainer 28. The end 42 of the cable is shown received within the cable pocket 36 at the bottom 24 of the front plate carrier 12. The cable retention portions are separated by gaps 86, which result in exposed portions 88 of the cable where the cable passes between cable retention portions. The cable retainer is attached to the front 18 of the front plate carrier by securing straps 92. The securing straps are threaded between the cable retention portions, pass over the bars, and are bar tack sewn onto the front plate carrier 12. Alternatively, the securing straps could be attached to the front plate carrier by hook and loop fasteners.

Figure 3:
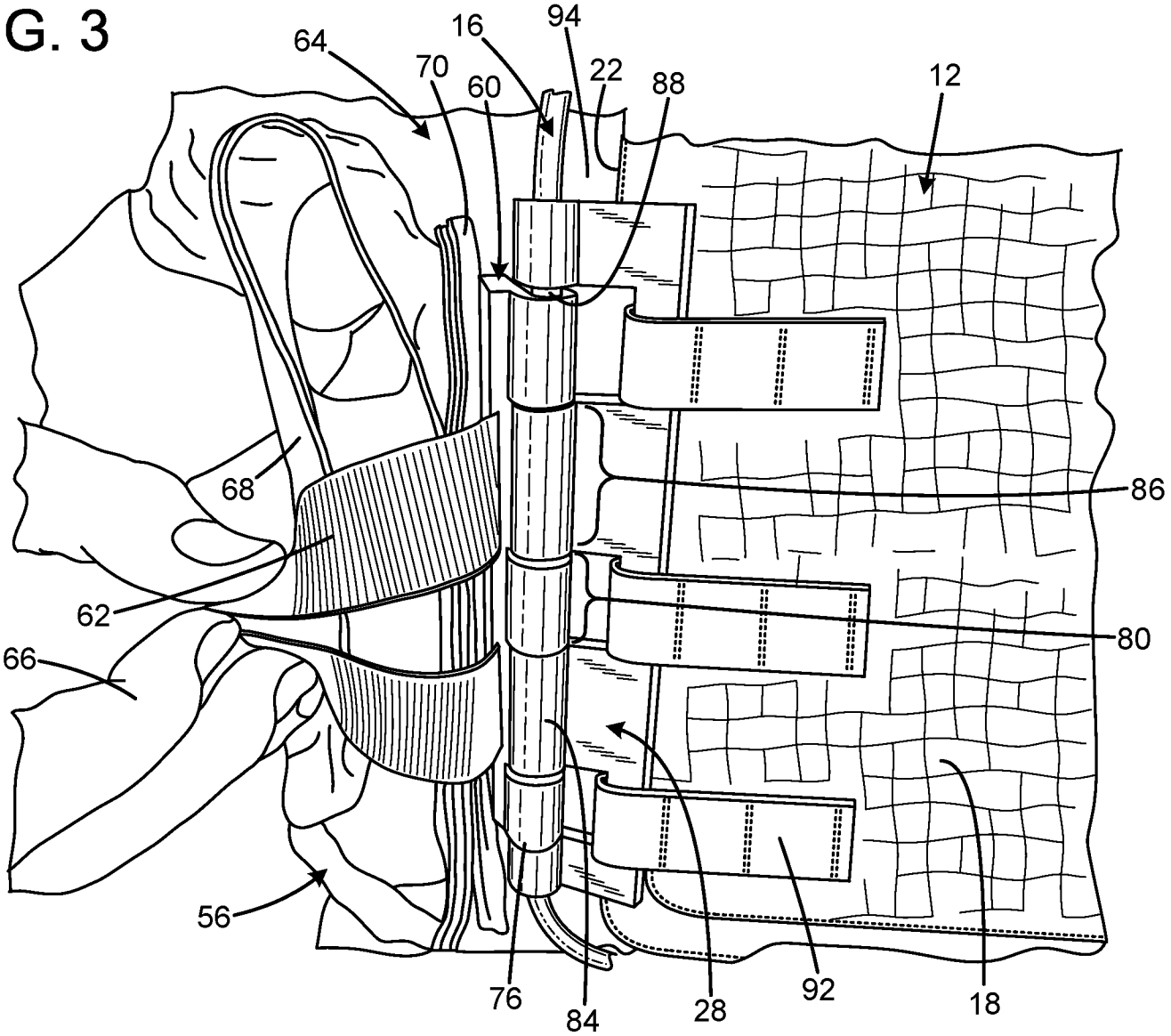
FIG. 3 is an enlarged front view of the current embodiment of the right cummerbund and cable retainer of FIG. 1 in the attached condition.

FIG. 3 illustrates the improved right cummerbund 56 and the cable retainer 28 on the bottom 24 of the right side 22 of the front plate carrier 12 of the present invention. More particularly, the right cummerbund is shown in the attached position with the operator 64 having donned the utility garment 10. The gaps 86 between the hooks 76 of the hooking device 60 are sized to closely receive the cable retention portions 84 of the cable retainer 28. Similarly, the gaps 80 between the cable retention portions 84 are sized to closely receive the hooks of the hooking device. As a result, the exposed portions 88 of the cable 16 pass through the gaps 96 in the hooks and are releasably retained within the hooks to attach the right cummerbund 56 to the front plate carrier 12. The hooking devices located on the other portions of the rear plate carrier 14 and the cable retainers located on the other portions of the front plate carrier are aligned in a similar fashion to attach the right shoulder portion 50, left shoulder portion 48, and left cummerbund 54 to the corresponding portions of the front plate carrier by releasably retaining exposed portions of the cable within the hooks.

Figure 4:
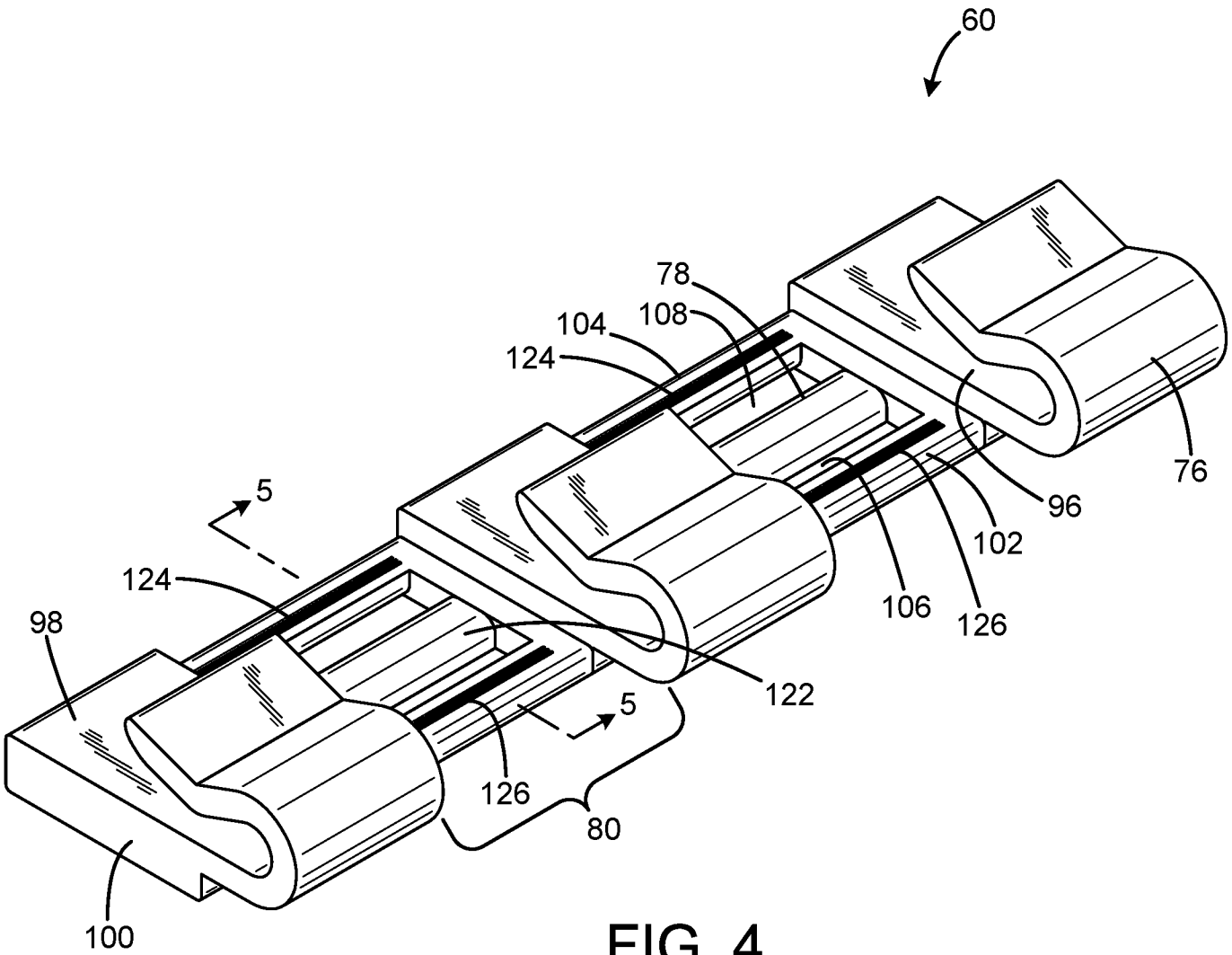
FIG. 4 is a back isometric view of the current embodiment of the hooking device of FIG. 1 removed from the utility garment.
Figure 5:
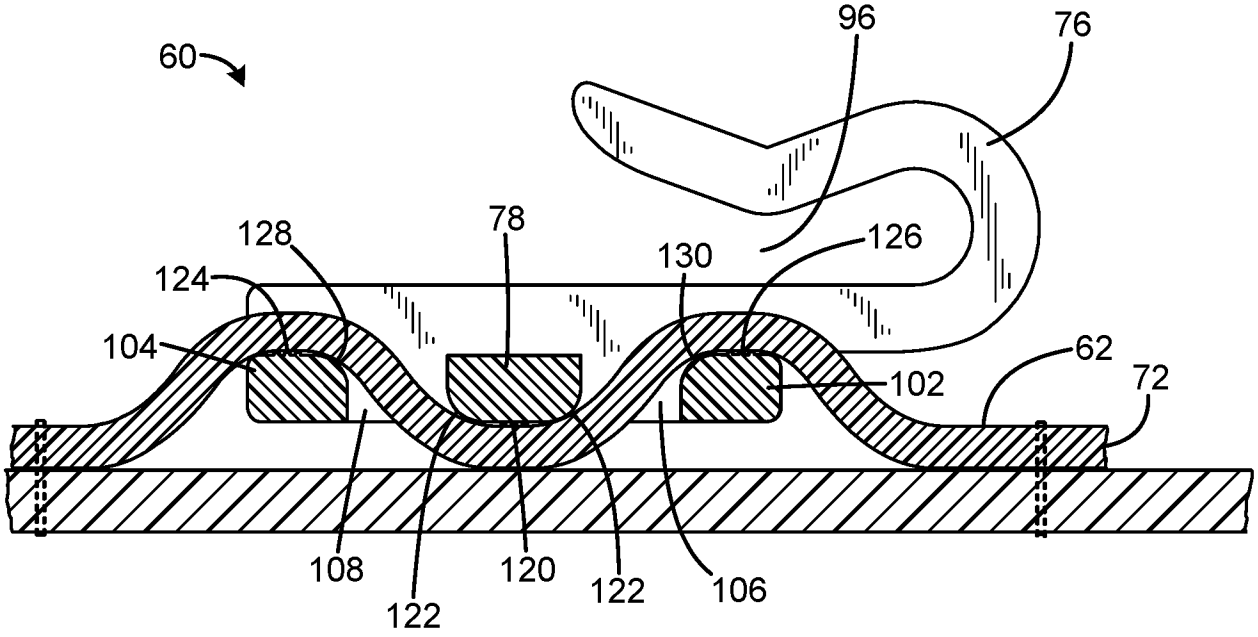
FIG. 5 is a sectional view of the current embodiment of the hooking device of FIG. 4 showing the path of the handle strap.

FIGS. 4 and 5 illustrate the improved hooking device 60 of the present invention. More particularly, the hooking device has a back 98 and a front 100. The back forms three hooks 76 in the current embodiment, although there could be as few as one or more than three hooks. In the current embodiment, two hooks are preferred for the left shoulder portion 48 and right shoulder portion 50, and three hooks are preferred for the left cummerbund 54 and right cummerbund 56. The hooks are connected by a front bar 102, a center bar 78, and a rear bar 104. A front slot 106 is present between the front bar and the center bar, and a rear slot 108 is present between the center bar and rear bar. The back side of the center bar has gripper bars 120 and chamfers 122 on either side of the gripper bars. The front side of the front bar and rear bar have gripper bars 124, 126 and chamfers 128, 130 on either side of the gripper bars. As is shown in FIG. 5, the opposed ends 72, 74 of the handle strap 62 are threaded under the rear bars, upward through the rear slots, over the center bars, downward through the front slots, and under the front bars to attach the hooking device to the handle strap.

Figure 6:
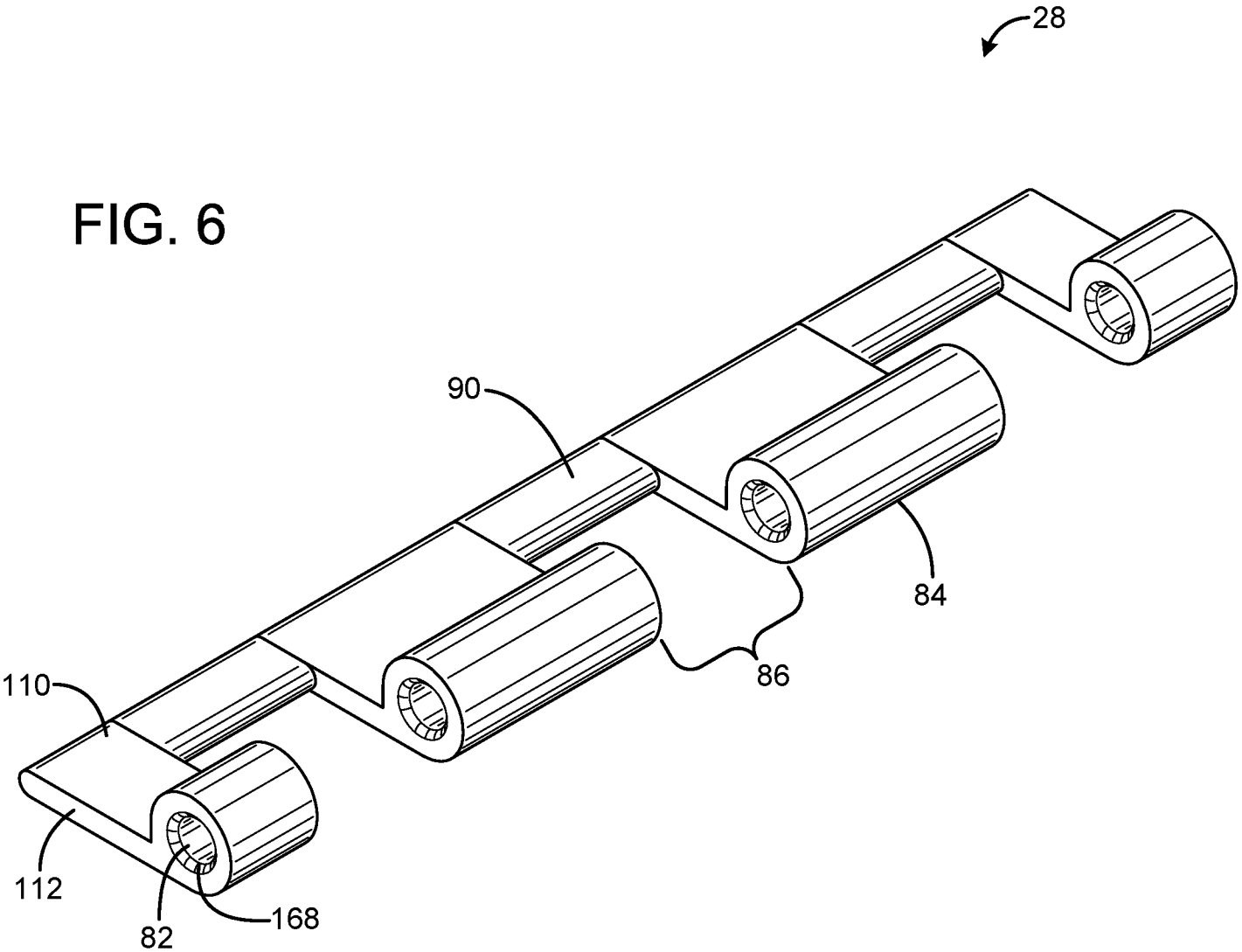
FIG. 6 is a back isometric view of the current embodiment of the cable retainer of FIG. 1 removed from the utility garment.
Figure 7:
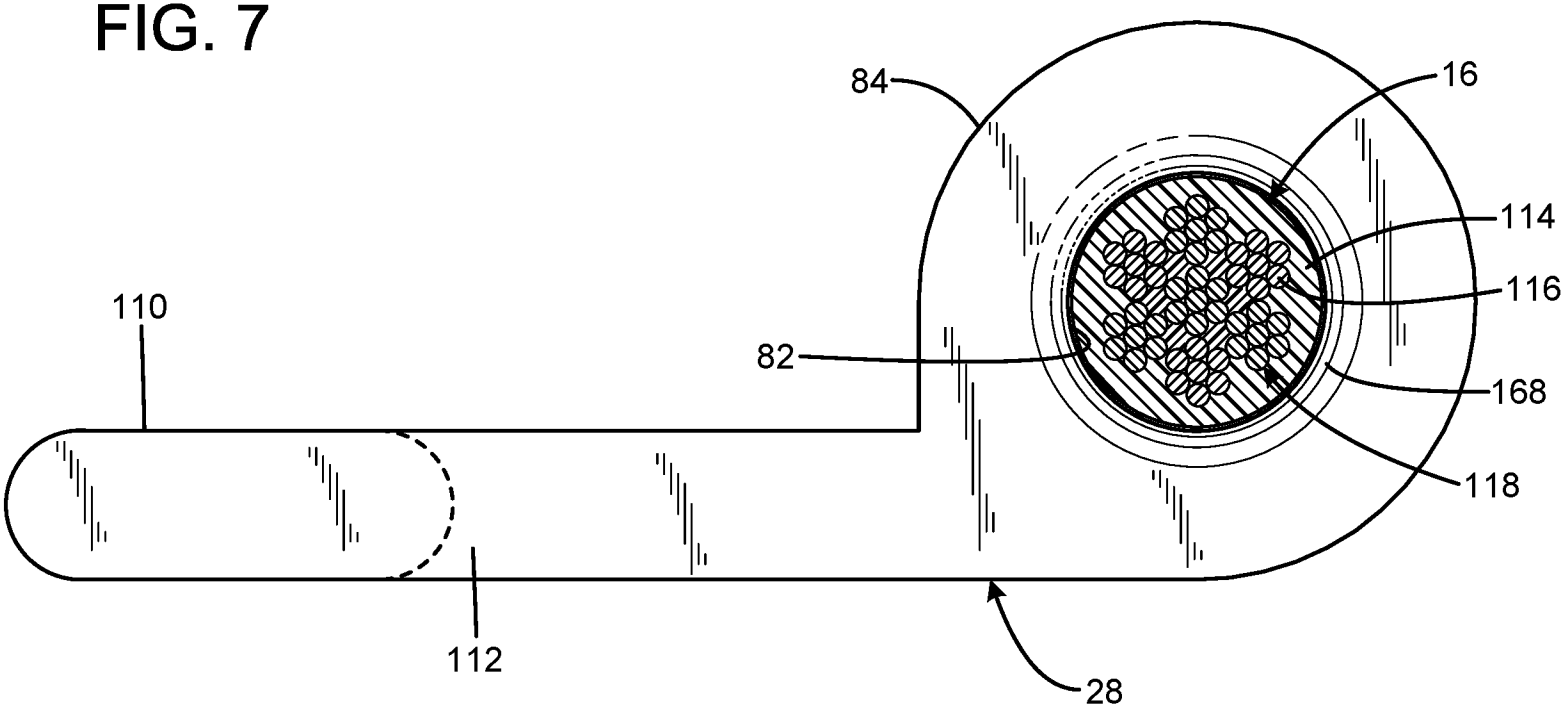
FIG. 7 is a sectional view of the current embodiment of the cable retainer of FIG. 6 receiving the quick-release cable.

FIGS. 6 and 7 illustrate the improved cable retainer 28 of the present invention. More particularly, the cable retainer has a back 110 and a front 112. The back forms four cable retention portions 84 in the current embodiment, although there could be as few as two or more than four cable retention portions. Although the cable retention portions are depicted as being two larger and two smaller cable retention portions, the cable retention portions can also be of a uniform size. The cable retention portions are connected by bars 90 that are the same length as the gap 86 between the cable retention portions. Each cable retention portion has a central aperture 82 that has a chamfer 168 to facilitate insertion of an end 42, 44 of the quick-release cable 16 when the cable is threaded through the apertures. All of the apertures in the cable retention portions are aligned on a common axis to facilitate insertion of the quick-release cable 16. In the current embodiment, the cable retainer is made of plastic.

As is shown in FIG. 7, the quick-release cable 16 is a coated aircraft cable. The cable must be sufficiently stiff and possess sufficient shear strength to jump the gap 86 between the cable retention portions 84 to secure the hooks 76 of the hooking device 60 to the front plate carrier 12. As an example, the stiffness of the cable should be able to resist buckling in response to an axial compression force of one pound applied at two points spaced apart by five times the diameter of the cable. However, the cable must also be flexible enough to bend around the perimeter of the front plate carrier 12. As an example, the cable should be able to form a bend of at least 180° over its length. In the current embodiment, the coating 114 of the cable is nylon or vinyl, and the cable has a 7×7 strand core. This means that each strand 118 is composed of seven wires 116. In the current embodiment, the wires are galvanized steel, and the cable has a length of less than six feet. However, the cable could be made of molded nylon possessing adequate shear strength and stiffness to feed through the cable retainers 28.

Figure 8:
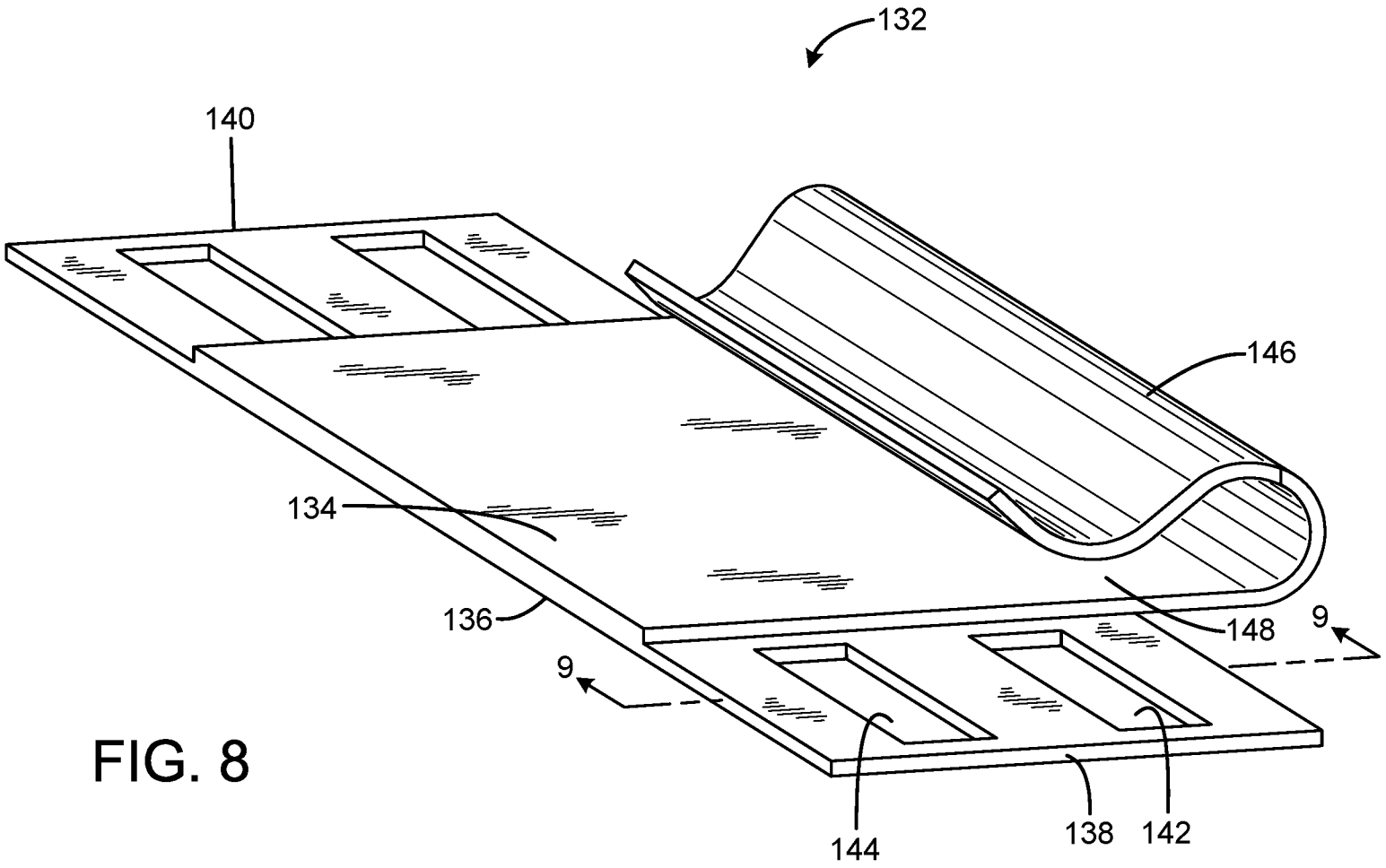
FIG. 8 is back isometric view of an alternative embodiment of the hooking device removed from the utility garment.
Figure 9:
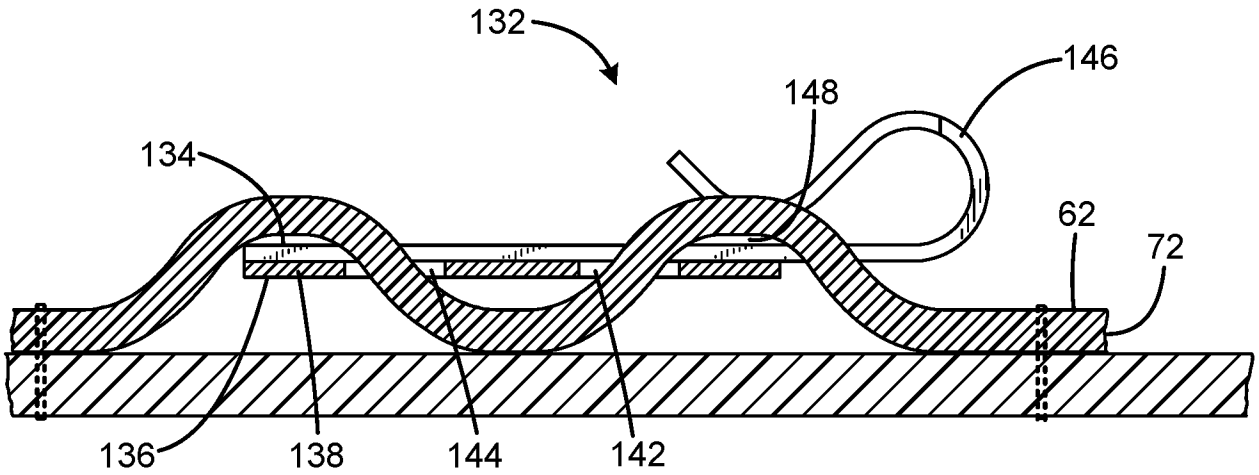
FIG. 9 is a sectional view of an alternative embodiment of the hooking device of FIG. 8 showing the path of the handle strap.

FIGS. 8 and 9 illustrate an alternative embodiment of the improved hooking device 132 of the present invention. More particularly, the hooking device has a back 134, a front 136, a top portion 138, and a bottom portion 140. The back forms a single hook 146 with a gap 148 in the current embodiment. The gap 148 tapers from a portion that is wider than the diameter of the quick-release cable 16 to a portion that is slightly narrower than the diameter of the quick-release cable. The hook is sufficiently flexible to snap over and releasably retain the cable, but with sufficient resistance that the hook will not inadvertently permit the cable to escape. The hook is connected to the top and bottom portions. Both the top and bottom portions each have a front slot 142 and a rear slot 144. As is shown in FIG. 9, the opposed ends 72, 74 of the handle strap 62 are threaded upward through the rear slots, over the top portion, downward through the front slots, and under the top portion to attach the alternative embodiment of the hooking device to the handle strap. In the alternative embodiment, the hooking device is made from a galvanized spring steel sheet.

Figure 10:
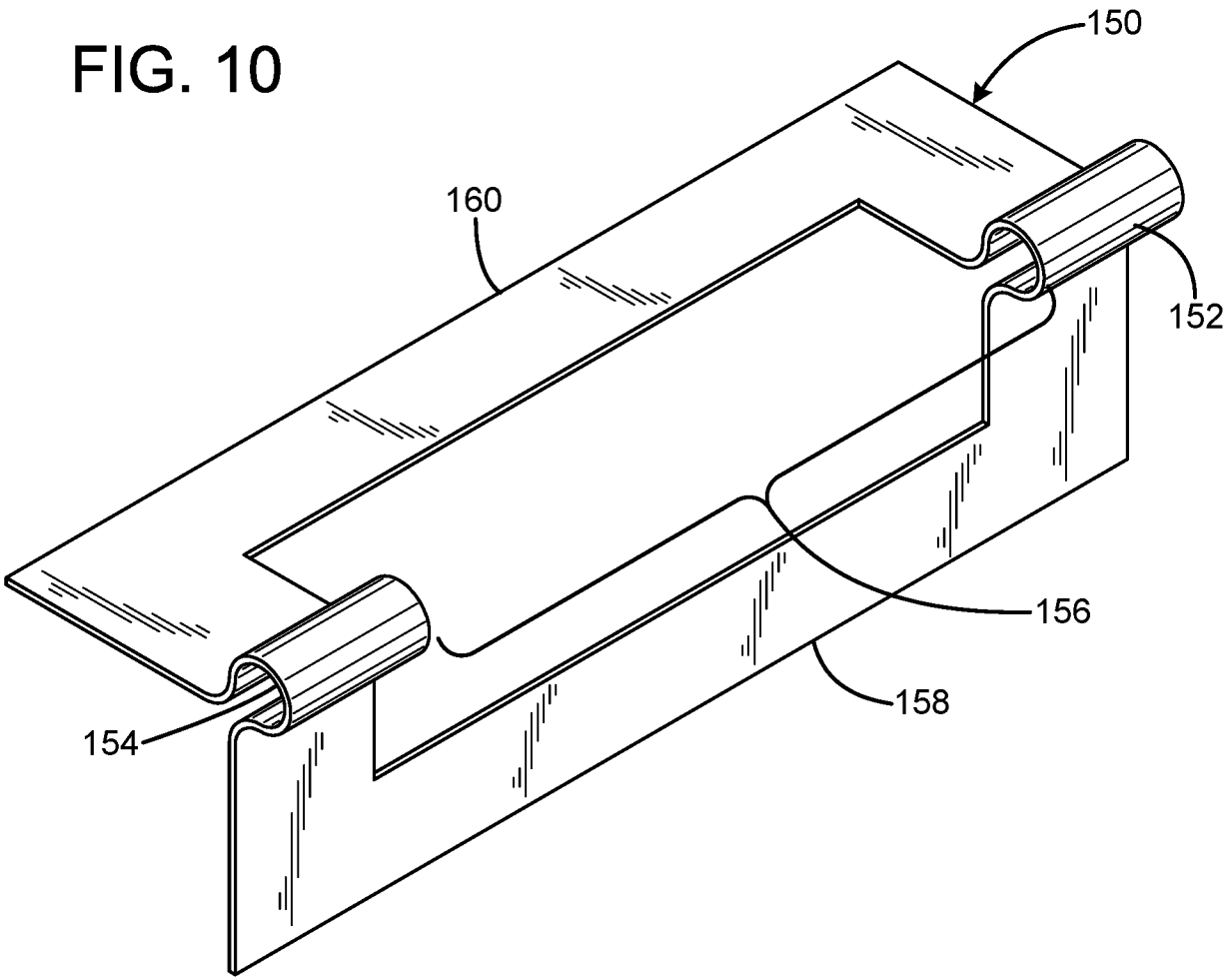
FIG. 10 is a back isometric view of an alternative embodiment of the cable retainer removed from the utility garment.
Figure 11:
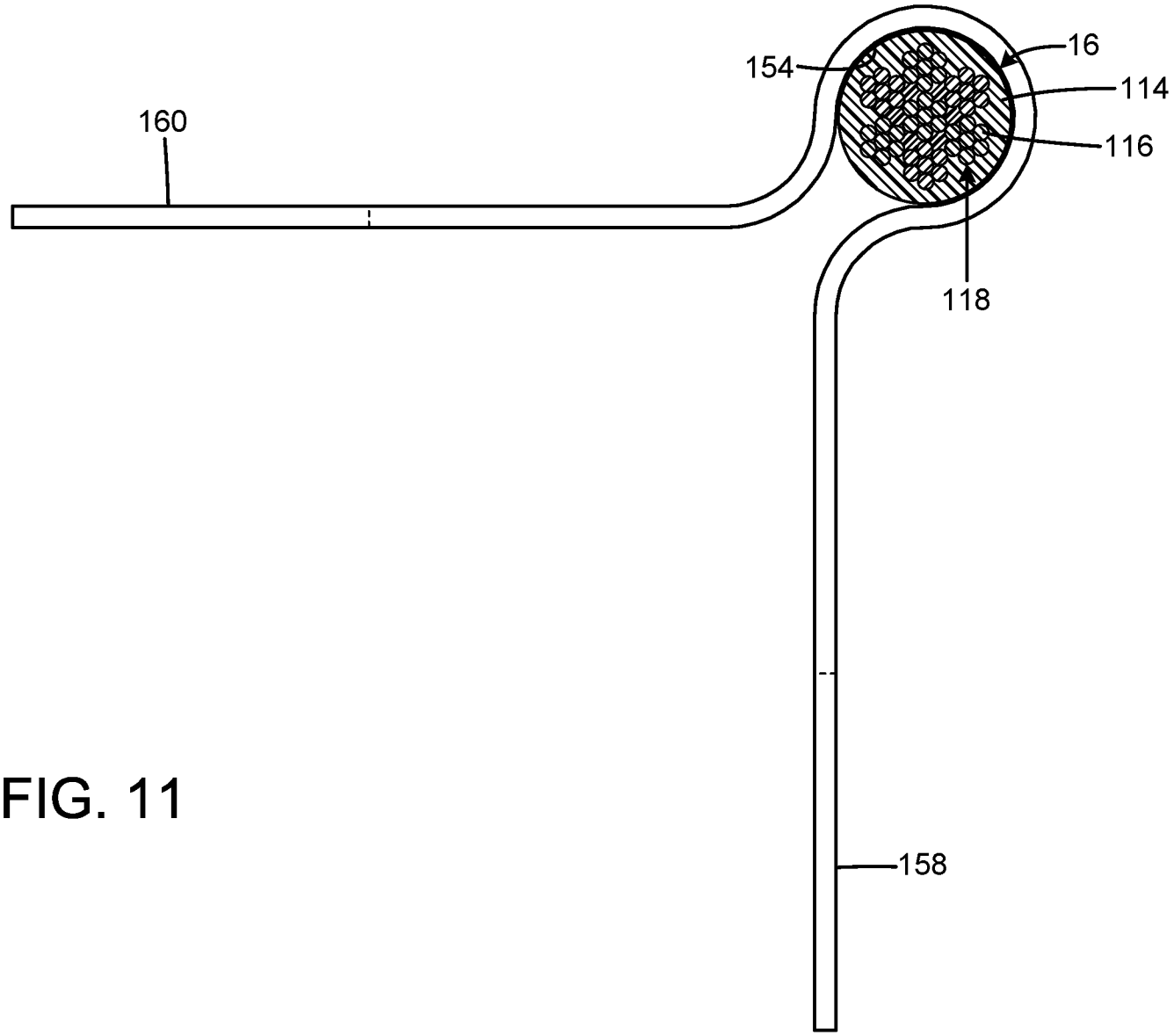
FIG. 11 is a sectional view of an alternative embodiment of the cable retainer of FIG. 10 receiving the quick-release cable.

FIGS. 10 and 11 illustrate an alternative embodiment of the improved cable retainer 150 of the present invention. More particularly, the cable retainer is generally triangular in cross-section with a front leg 158 and a rear leg 160. The junction between the legs forms two cable retention portions 152 in the current embodiment. The cable retention portions are separated by a gap 156 that is sized to closely receive the hook 146 of the hooking device 132. Each cable retention portion has a central aperture 154 that is sufficiently wide to receive an end 42, 44 of the quick-release cable 16 when the cable is threaded through the apertures. In the alternative embodiment, the cable retainer is made from a galvanized spring steel sheet.

Figure 12:
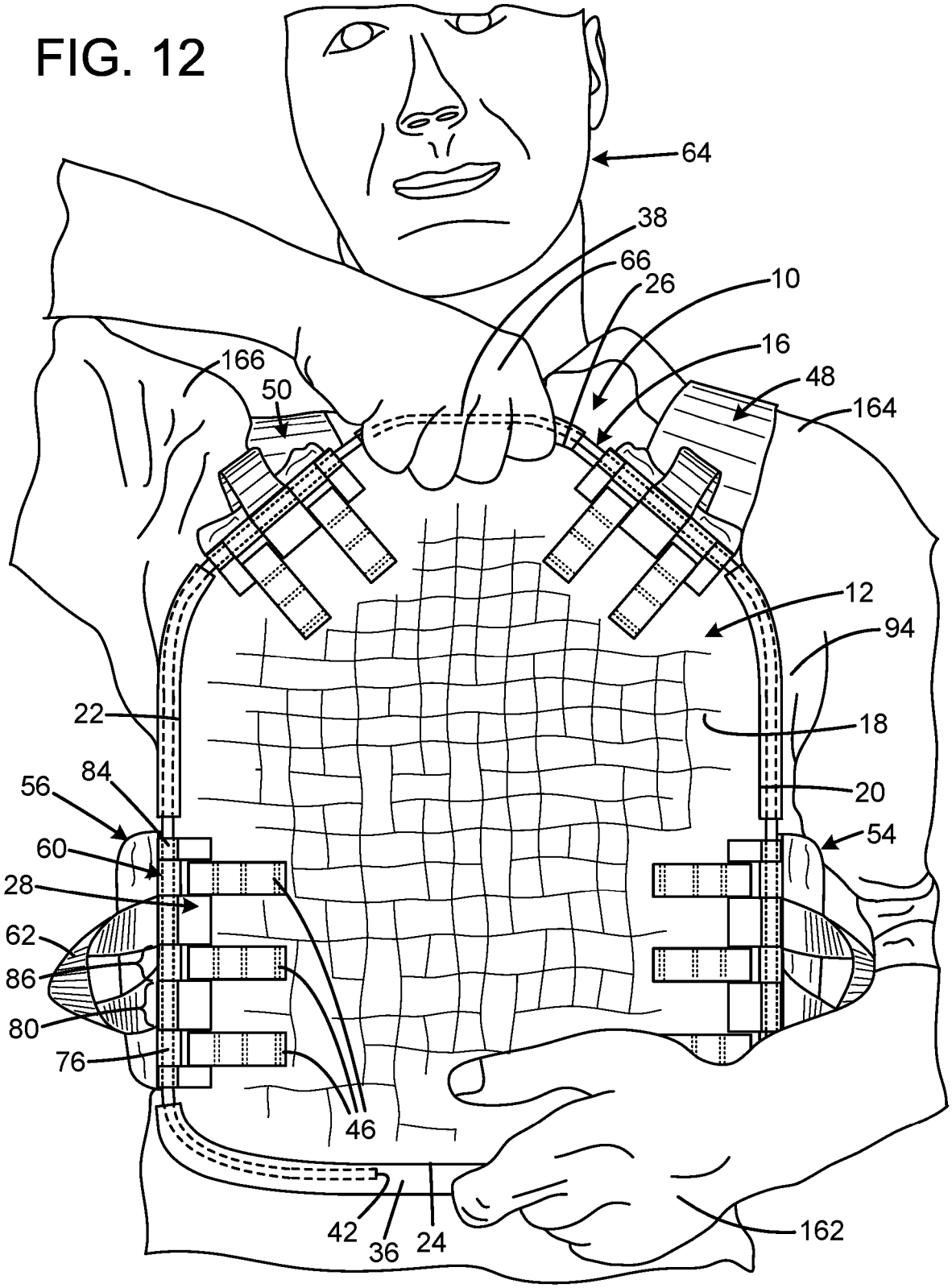
FIG. 12 is a front view of the current embodiment of the utility garment of FIG. 1 with the operator initiating the quick-release process.
Figure 13:
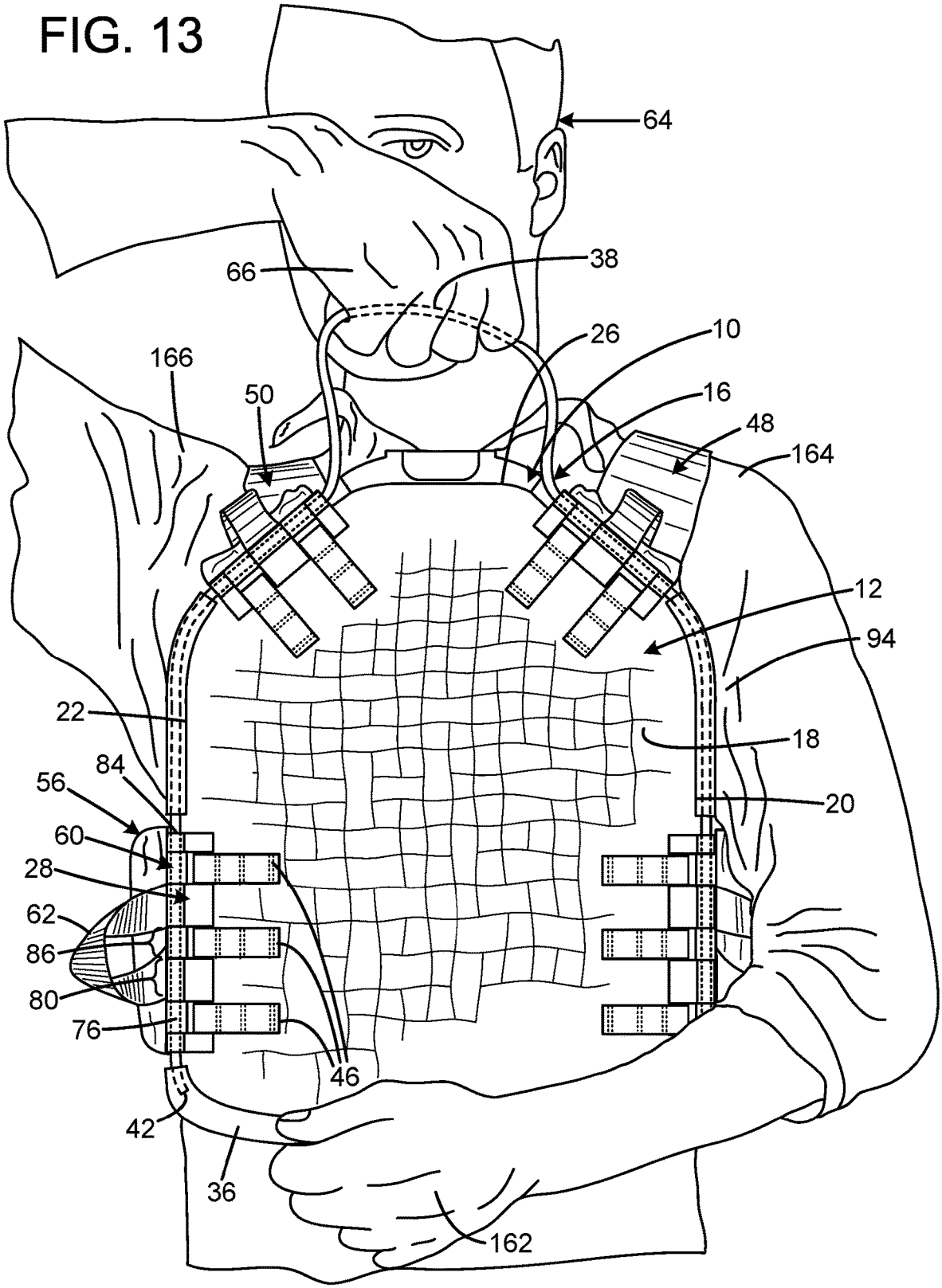
FIG. 13 is a front view of the current embodiment of the utility garment of FIG. 1 with the operator at the midpoint of the quick-release process.
Figure 14:
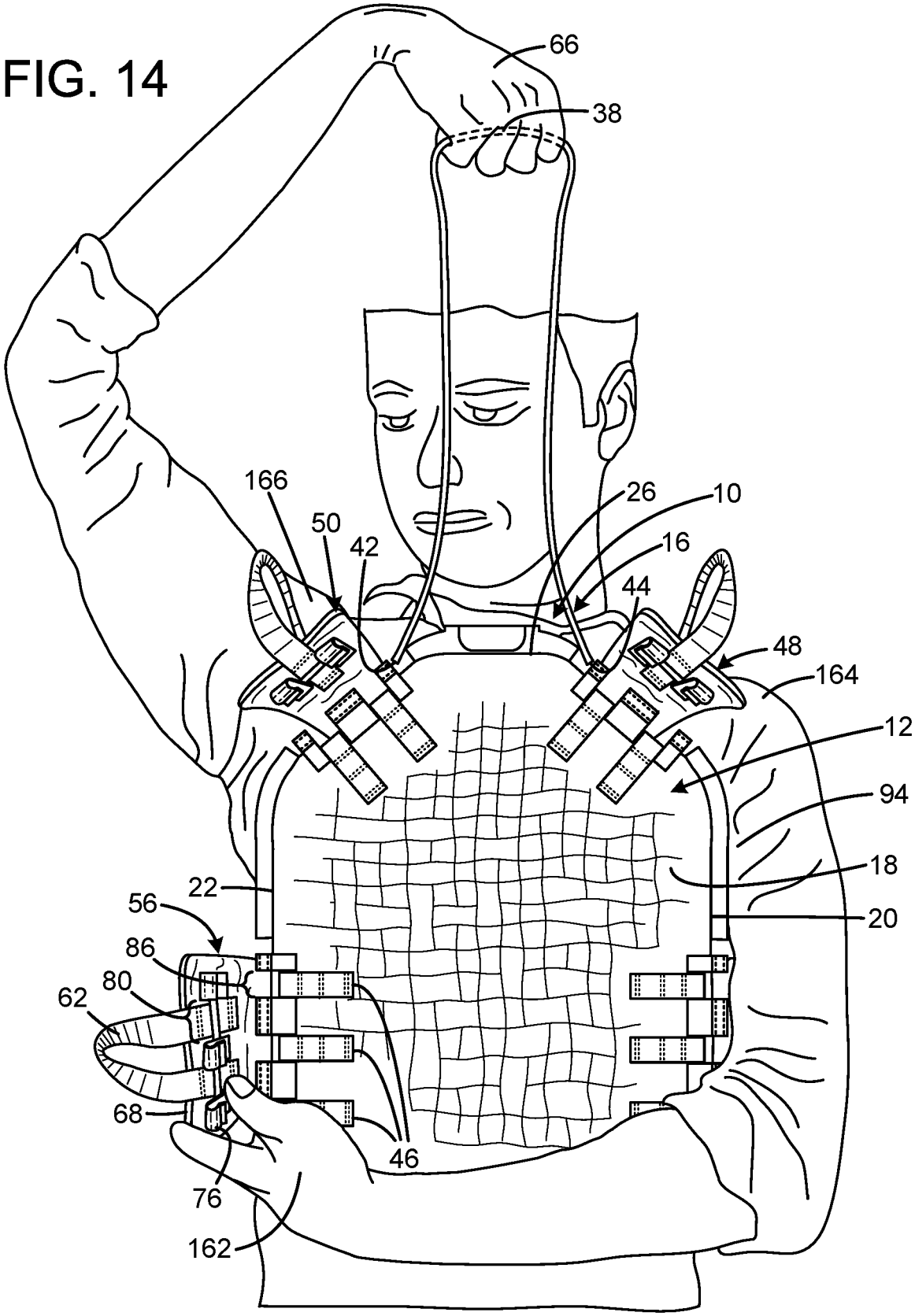
FIG. 14 is a front view of the current embodiment of the utility garment of FIG. 1 with the operator having just completed the quick-release process.

FIGS. 12-14 illustrate how the quick-release cable 16 can be pulled upward by the operator 64 to rapidly detach the utility garment 10 from the torso 94 after the utility garment has been donned conventionally. More particularly, the utility garment is normally donned and removed by using the handle straps 62 to engage and disengage the hooking devices 62 with the exposed portions 88 of the cable threaded through the cable retainers 28. These actions secure the left shoulder portion 48 over the left shoulder 164, the right shoulder portion 50 over the right shoulder 166, and the left and right cummerbunds 54, 56 to the left and right sides 20, 22 of the front plate carrier so the front and rear plate carriers 12, 14 cover the operator's torso. However, in an emergency situation, such as when the operator is immersed in water or wounded and torso access is needed, a faster and more convenient release method is provided via the cable.

Specifically, in FIG. 12, the operator 64 begins the emergency detach or egress procedure by grasping the midpoint or central portion 38 of the quick-release cable 16 with one hand (the right hand 66 is shown) and grasping the bottom 24 of the front plate carrier 12 with the other hand (the left hand 162 is shown). The operator then pulls the midpoint of the cable upwards and pulls the front plate carrier downwards to withdraw the ends 42, 44 of the cable from the cable pocket 36 attached to the bottom of the front plate carrier.

FIG. 13 shows an intermediate portion of the emergency detach procedure. The quick-release cable 16 has been pulled upwards by the operator 64 and has begun unthread from the cable retainers 28.

FIG. 14 shows the final stage of the emergency detach procedure. The ends 42, 44 have just withdrawn from the cable retainers 28 attached to the top 26 of the left side 20 and right side 22. With the cable withdrawn from all of the cable retainers 28, all of the hooking devices 60 have popped free from the cable retainers, which enables the front plate carrier 12 and the rear plate carrier 14 to freely detach from the operator 64 and fall off.

Figure 15:
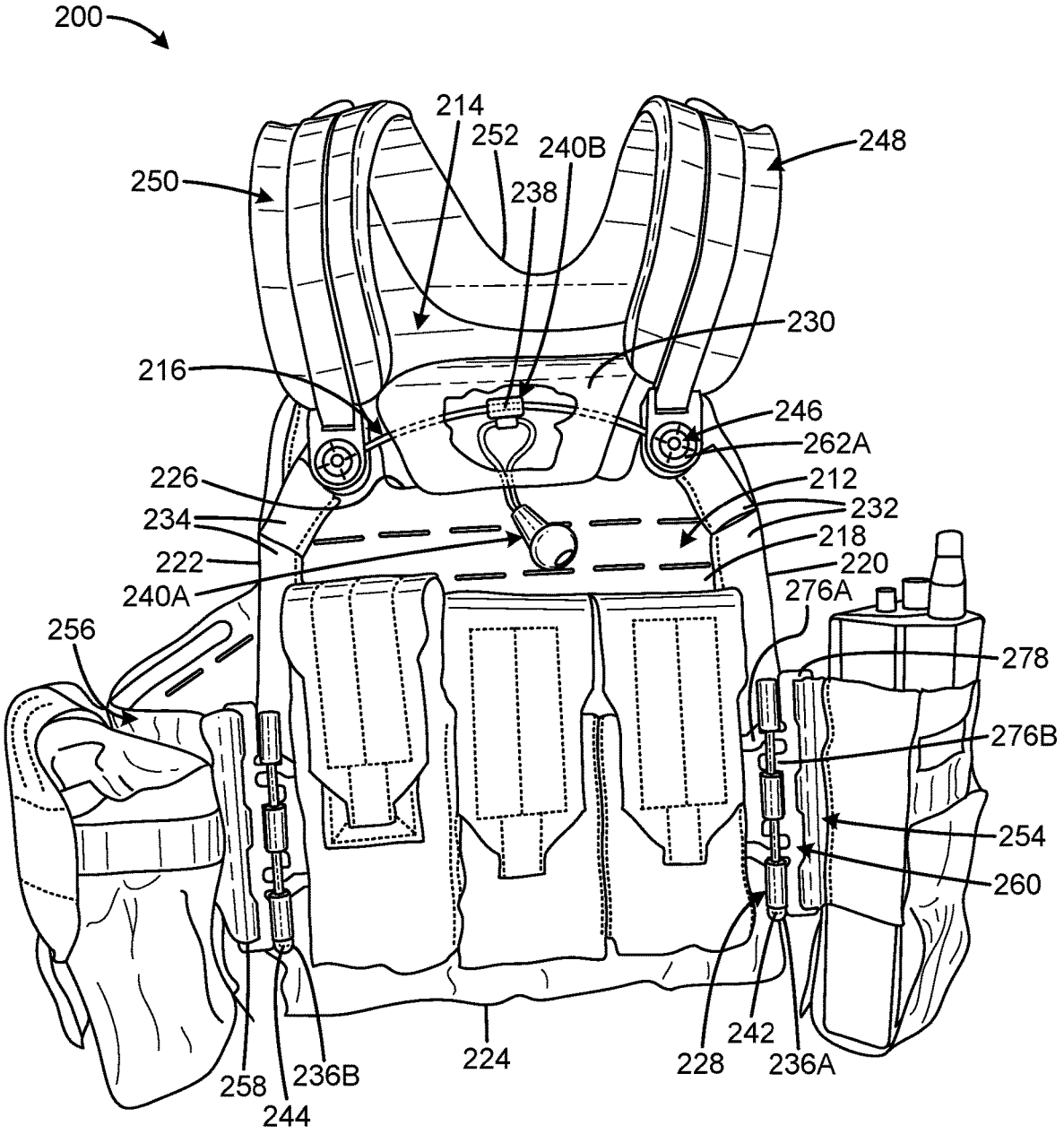
FIG. 15 is a front view of an alternative embodiment of the utility garment constructed in accordance with the principles of the present invention.

FIG. 15 illustrates an alternative embodiment of the improved utility garment 200 of the present invention. More particularly, the utility garment is a loadbearing armor plate carrier vest that has a front plate carrier 212 and a rear plate carrier 214 that are removably detachable at a plurality of attachment facilities. The front plate carrier is a front garment portion adapted for positioning at a wearer 64/operator's chest. The rear plate carrier is a rear garment portion adapted for positioning at a wearer's back. The front plate carrier has a front 218, left side 220, right side 222, bottom 224, and top 226 (oriented from the perspective of the operator). Two cable retainers 228 are connected at the bottom of the left and right sides of the front plate carrier. Two shoulder buckles 246 are connected at the top of the left and right sides of the front plate carrier. A cable flap 230 is attached to the top of the front plate carrier and extends between the two shoulder buckles. A cable pocket 232 is attached to the left side of the front plate carrier and extends between the shoulder buckle on the left side and the cable retainer on the left side. A cable pocket 234 is attached to the right side of the front plate carrier and extends between the shoulder buckle on the right side and the cable retainer on the right side. Cable end caps 236A, 236B are attached to the cable retainers. In the current embodiment, the cable flap, cable pockets, and the shoulder buckles are sewn onto the front plate carrier.

An elongated quick-release cable 216 is positioned around the perimeter of the front plate carrier 212 such that the midpoint 238 of the cable is covered by the cable flap 230. The cable flap enables a quick-release pull tab 240A with connector 240B attaching the pull tab to the midpoint of the cable to be exposed to permit easy exertion of downward force upon the midpoint of the cable while protecting the operator from contact with the cable, connector, and pull tab. The opposed ends 242, 244 of the cable are threaded down the left side 220 and right side 222 of the front plate carrier. The opposed ends are threaded through the shoulder buckles 246, cable retainers 228, and the cable pockets 232, 234 and are received within the cable end caps 236A, 236B attached to the cable retainers.

The threading of the quick-release cable 216 around the perimeter of the front plate carrier 212 can be accomplished without any interaction with the rear plate carrier 214, which makes the threading process much easier compared with that of the prior art Modular Tactical Vest described previously. The prior art Modular Tactical Vest requires both the front plate carrier and the rear plate carrier to be precisely aligned during the cable threading process. This feature of the current invention makes routine operator practice to develop muscle memory for the emergency quick-release procedure practical and also greatly reduces the risk that the utility garment 200 will be reassembled incorrectly.

The rear plate carrier 214 forms a left shoulder portion 248 and a right shoulder portion 250 on either side of the top 252. The rear plate carrier also forms a left cummerbund 254 and right cummerbund 256 on either side of the bottom 258. Each of the cummerbunds has an attached hooking device 260. Each of the shoulder portions has an attached top buckle portion 262A that is releasably secured by the quick-release cable 216 to a lower buckle portion 262B (shown in FIG. 24) that is connected to the top 226 front 218 of the front plate carrier 212. The hooking devices on the cummerbunds are each positioned such that they align with a corresponding cable retainer 228 on the front plate carrier when the utility garment 200 is donned. Thus, the front garment portion and rear garment portion are removably detachable at a plurality of attachment facilities (the hooking devices, cable retainers, top buckle portions, and lower buckle portions). Each attachment facility includes a front facility portion connected to the front garment portion and a rear facility portion connected to the rear garment portion.

Figure 16:
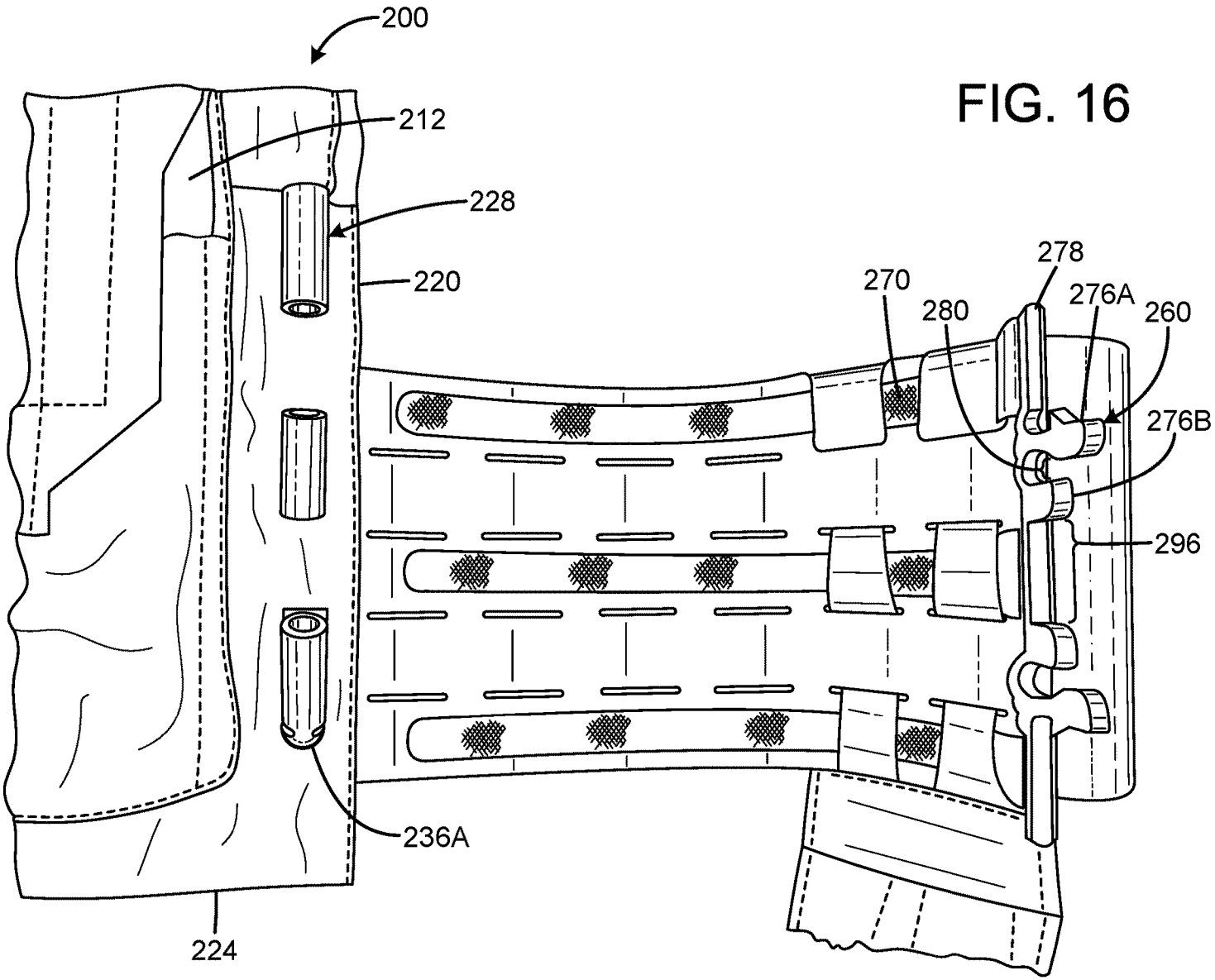
FIG. 16 is an enlarged front view of the alternative embodiment of the right cummerbund of FIG. 15 in the detached condition with the quick-release cable removed from the cable retainer.

FIG. 16 illustrates the improved left cummerbund 254 and the cable retainer 228 on the bottom 224 of the left side 220 of the front plate carrier 212 of the present invention. More particularly, the left cummerbund is shown in the detached position with the quick-release cable 216 removed from the cable retainer. The hooking device 260 is attached to the back 270 of the right cummerbund. The hooking device has a series of hooks 276A and tabs 276B that are attached to a center bar 278. The hooks and tabs are separated by gaps 280, and the tabs are separated by a gap 296. In the current embodiment, the hooking device is made of plastic.

Figure 17:
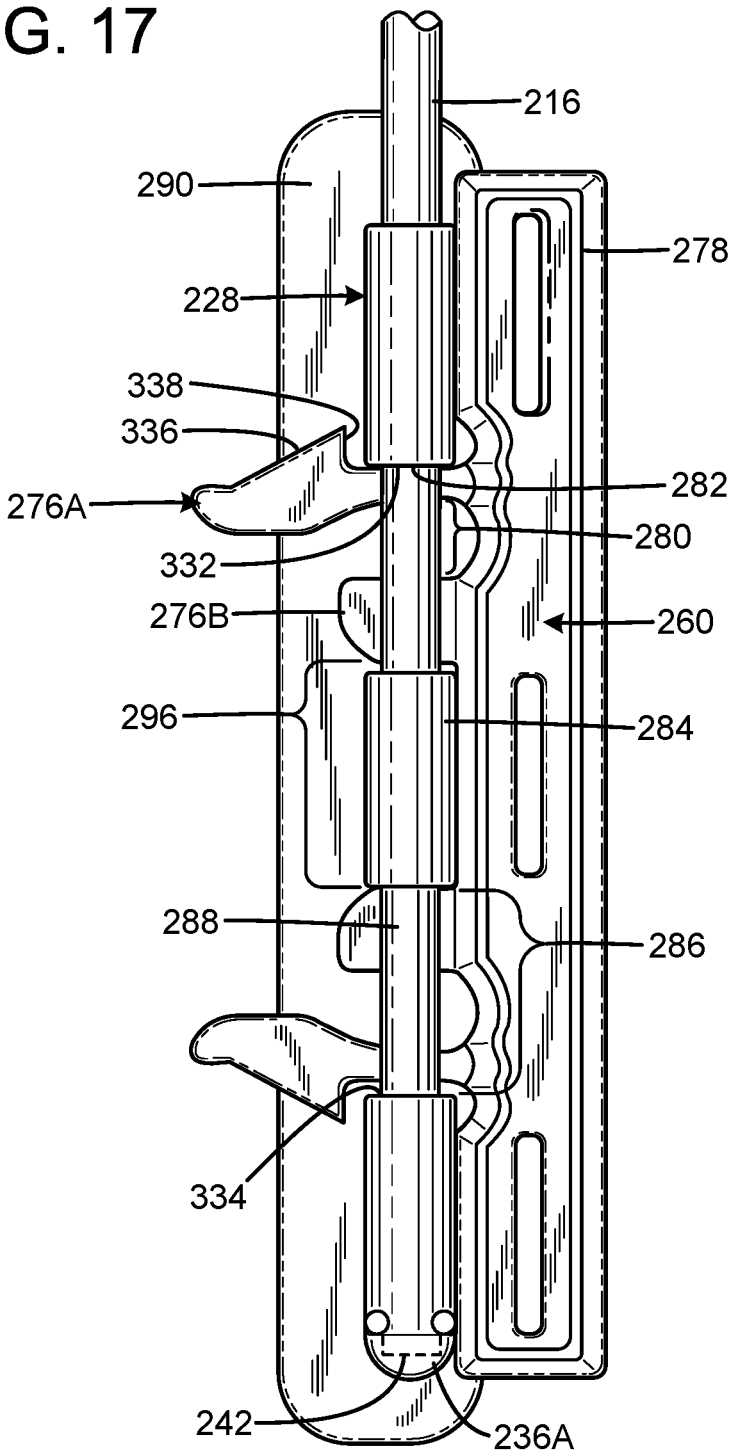
FIG. 17 is an enlarged front view of the alternative embodiment of the hooking device of FIG. 15 in the attached condition.

FIG. 17 illustrates the improved cable retainer 228, hooking device 260, and quick-release cable 216 in the attached position. More particularly, the quick-release cable 216 is shown threaded through central apertures 282 in a series of cable retention portions 284 that are held together by a bar 290 to form the cable retainer 228. Each of the central apertures has a chamfer to facilitate insertion of an end 242, 244 of the quick-release cable 216 when the cable is threaded through the apertures. All of the apertures in the cable retention portions are aligned on a common axis to facilitate insertion of the quick-release cable. In the current embodiment, the cable retainer is made of plastic, and the quick-release cable 216 is identical to the previously described quick-release cable 16. The end 242 of the cable is shown received within the cable end cap 236A. The cable retention portions are separated by gaps 286, which result in exposed portions 288 of the cable where the cable passes between cable retention portions. The hooks 276A are sufficiently flexible and resilient to pass through the gaps 286 and snap over the ends 332, 334 of the cable retention portions. The hooks define a ramp portion 336 and a raised step portion 338. The ramp portion facilitate insertion of the hooks through the gaps 286, and the step portions prevent withdrawal of the hooks through the gaps 286 when the quick-release cable 216 is present. The gap 296 between the tabs 276B closely receives a cable retention portion 284 to inhibit vertical movement of the hooking device. As a result, the hooking devices are releasably secured to the cable retainers to attach the left cummerbund 254 and right cummerbund 256 to the corresponding portions of the front plate carrier 212 when the quick-release cable is present.

Figure 18:
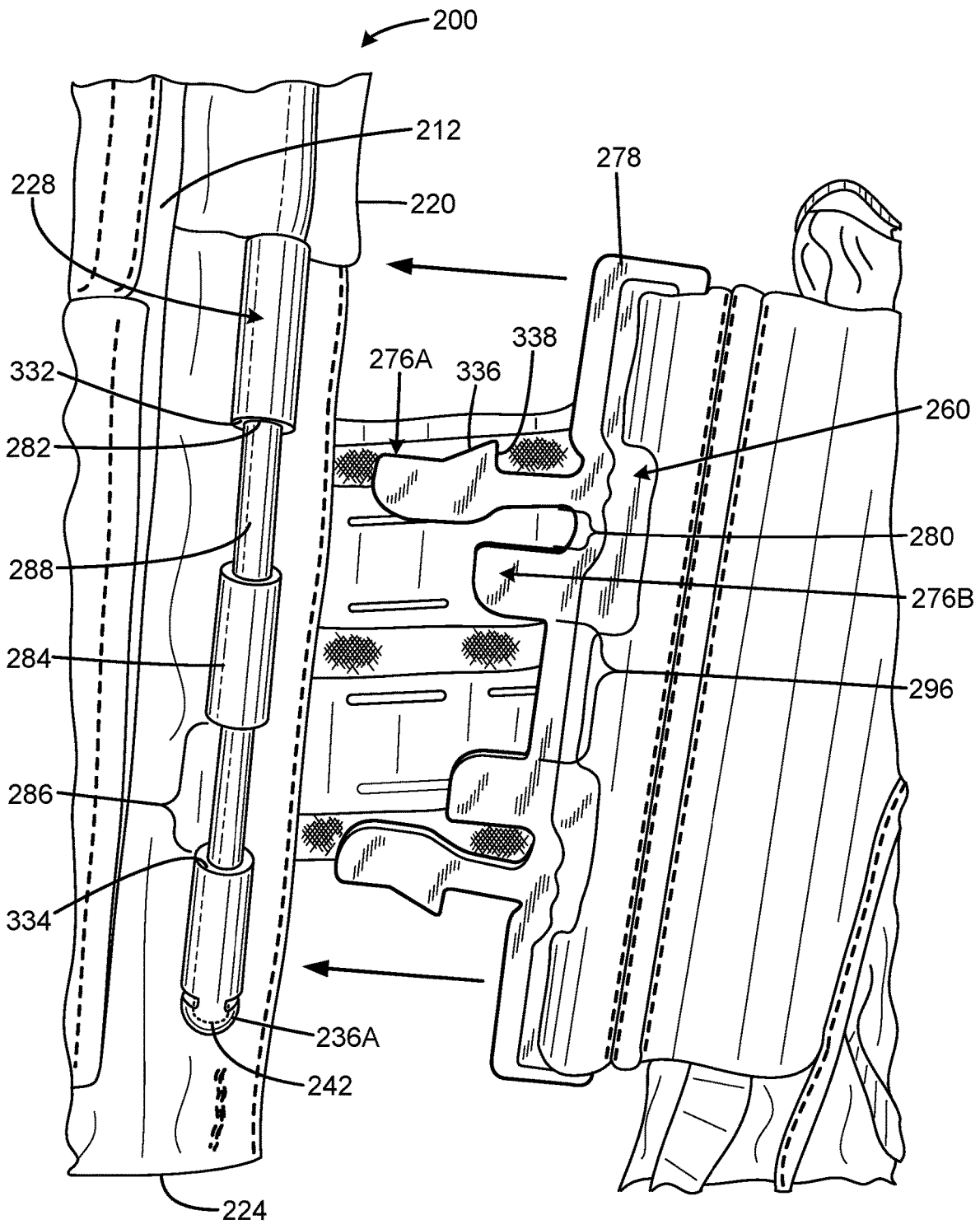
FIG. 18 is an enlarged front view of the alternative embodiment of the right cummerbund of FIG. 15 in the detached condition with the quick-release cable installed in the cable retainer to initiate the attachment process.
Figure 19:
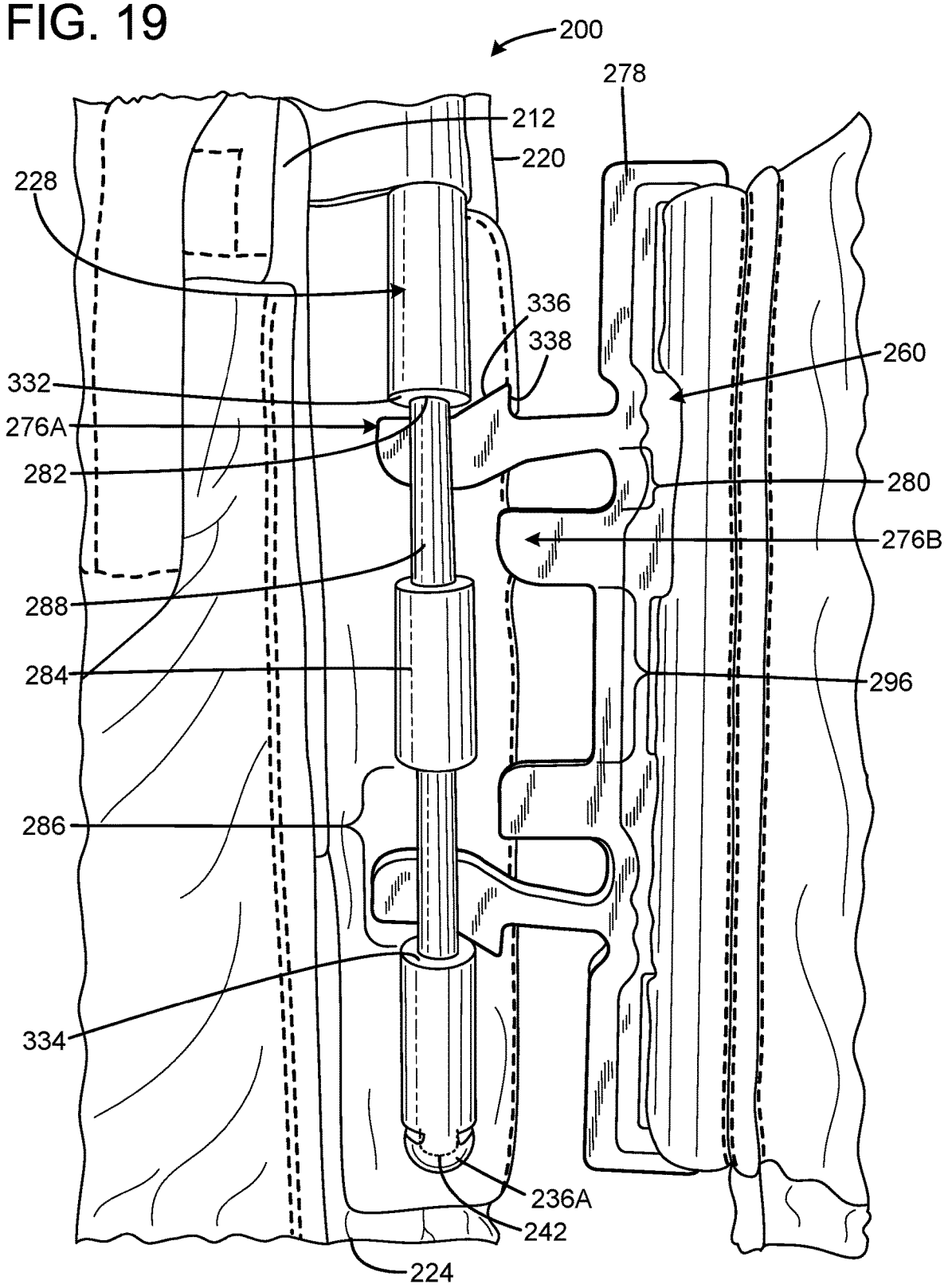
FIG. 19 is an enlarged front view of the alternative embodiment of the right cummerbund of FIG. 15 at the second step of the attachment process.
Figure 20:
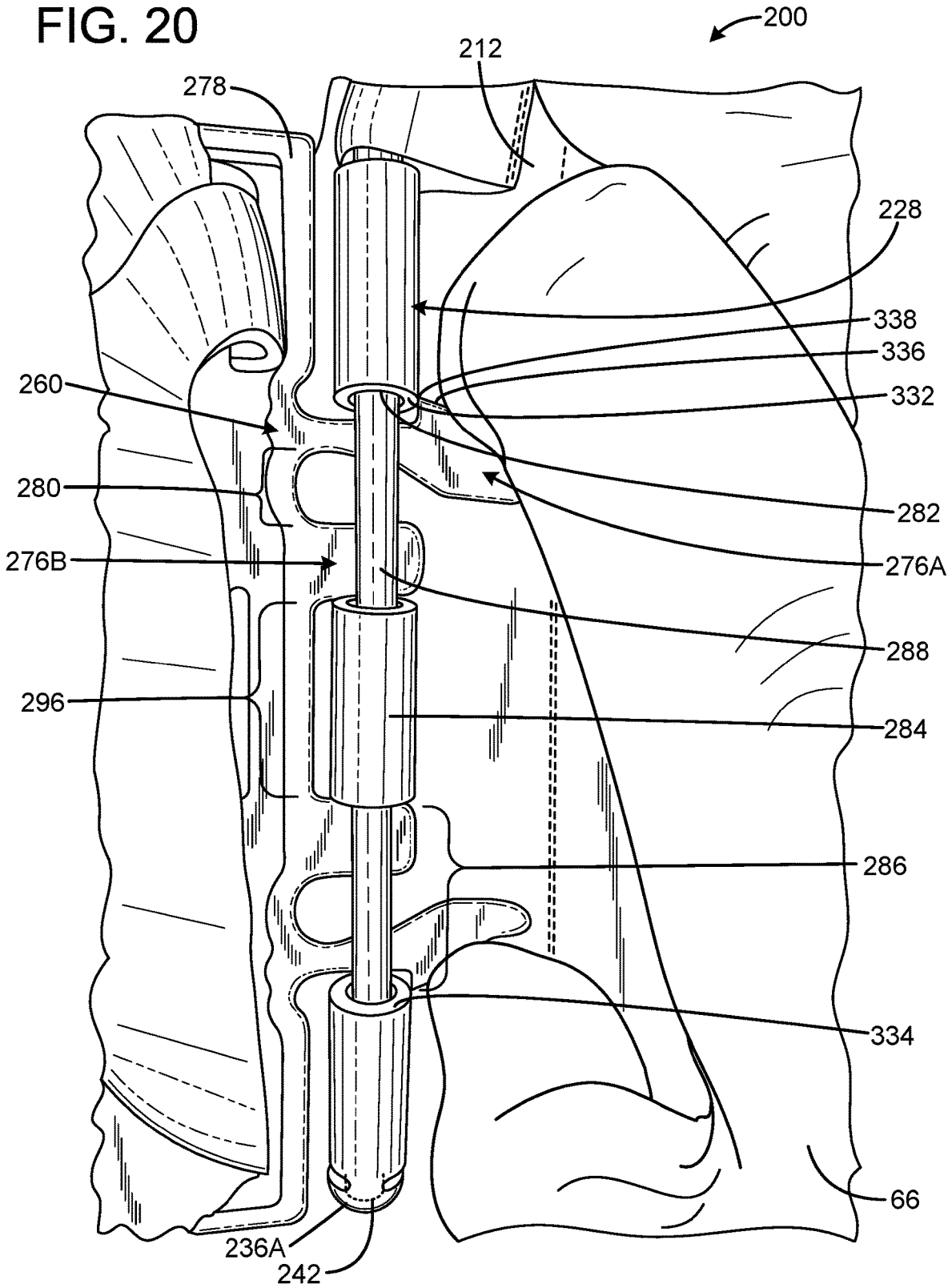
FIG. 20 is an enlarged front view of the alternative embodiment of the right cummerbund of FIG. 15 at the third step of the attachment process.

FIGS. 18 and 19 illustrate the process of donning the utility garment 200 to cover the torso of an operator 64. The operator's hand 66 grasps the one of the cummerbunds 254, 256 and pushes the associated hooking device 260 towards the corresponding cable retainer 228. The operator positions the hooking device such that each pair of hooks 276A and tabs 276B is aligned with a gap 286 between the cable retention portions 284. As the ramp portions 336 of the hooks encounter the ends 332, 334 of the cable retention portions, the hooks flex inwards towards the tabs to permit the hooks to pass through the gaps 286. If the hooks do not flex sufficiently to permit the raised step portions 338 to snap over the ends of the cable retention portions, the operator can pinch the ramp portions together as shown in FIG. 20 to further flex the hooks inwards until the raised step portions have snapped over the ends of the cable retention portions. Once the raised step portions have snapped over the ends of the cable retention portions, the hooks cannot be disengaged from cable retainers until the quick-release cable 216 is removed from the cable retainers.

FIG. 20 illustrates the normal, non-emergency process of removing the utility garment 200 from the torso 94 of the operator 64. More particularly, the utility garment is normally donned and removed by engaging and disengaging the hooking devices 262 with the cable retainers 228 while the quick-release cable 216 remains threaded through the cable retainers 228. Disengagement is accomplished by the operator's hand 66 pinching the hooks together until the raised step portions 338 of the hooks 276A can be pushed back through the gaps 286 between the cable retention portions 284. This action disconnects the cummerbunds 254, 256 from the front plate 212. The operator can then lift the shoulder portions 248, 250 over his or her head to remove the utility garment 200 since the quick-release cable continues to secure the shoulder portions to the front plate by the shoulder buckles 246.

FIGS. 21-24 illustrate how the quick-release cable 216 can be pulled upward by the operator 64 to rapidly detach the utility garment 200 from the torso 94 after the utility garment has been donned conventionally. More particularly, in an emergency situation, such as when the operator is immersed in water or wounded and torso access is needed, a faster and more convenient release method is provided via the quick-release cable.

Figure 21:
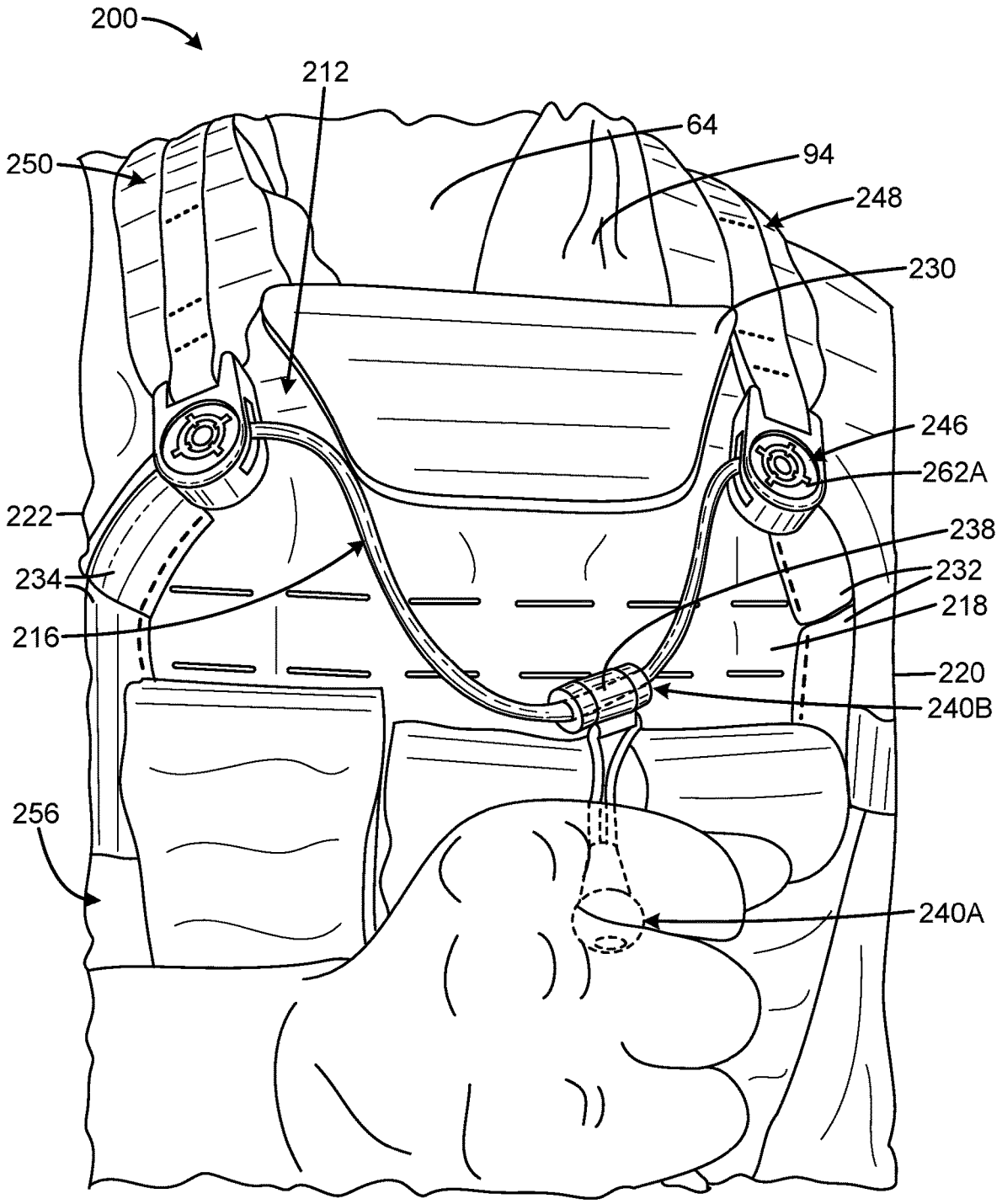
FIG. 21 is a front view of the alternative embodiment of the utility garment of FIG. 15 with the operator initiating the quick-release process.
Figure 22:
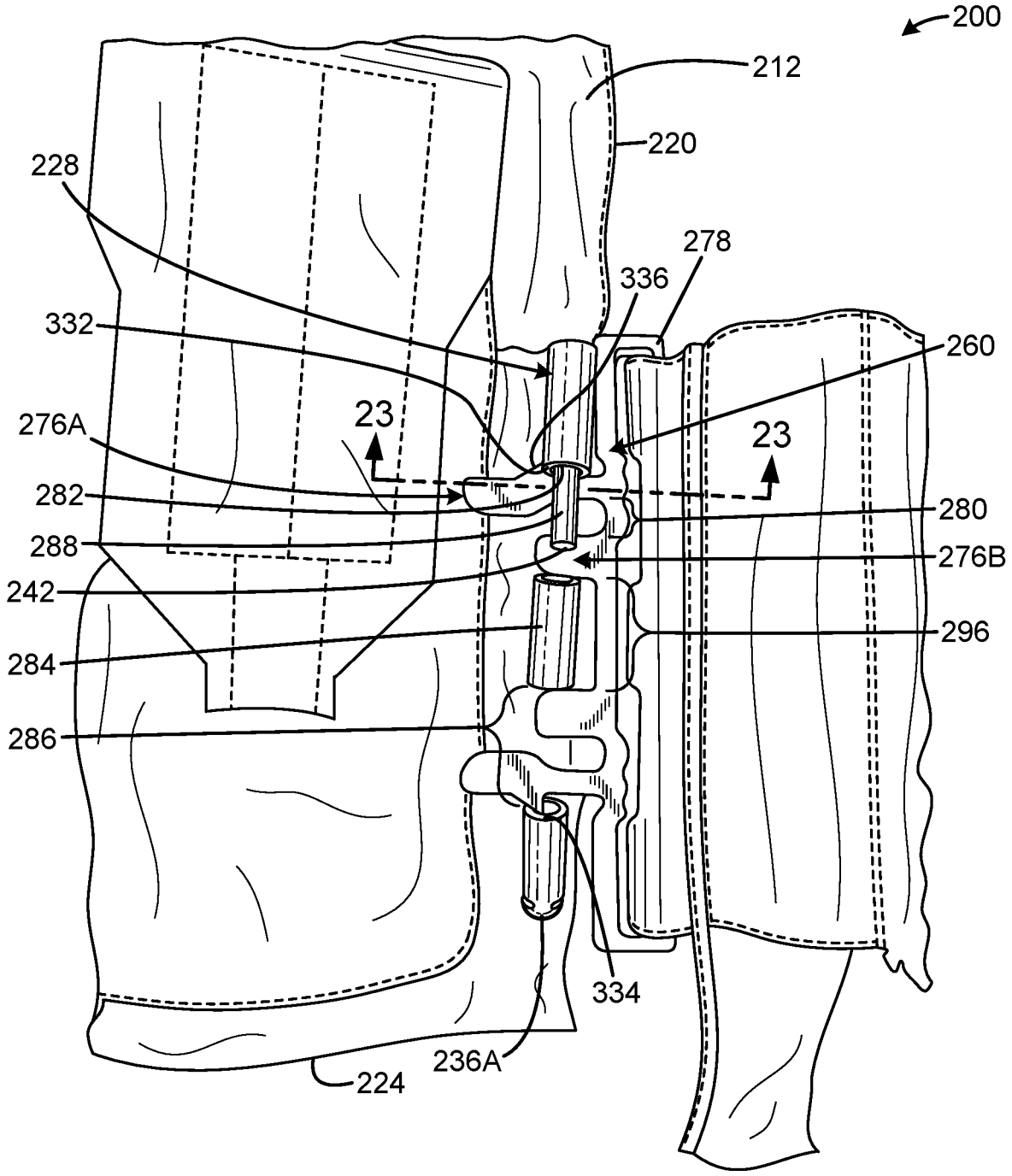
FIG. 22 is an enlarged front view of the alternative embodiment of the right cummerbund of FIG. 15 undergoing the quick-release process.
Figure 23:
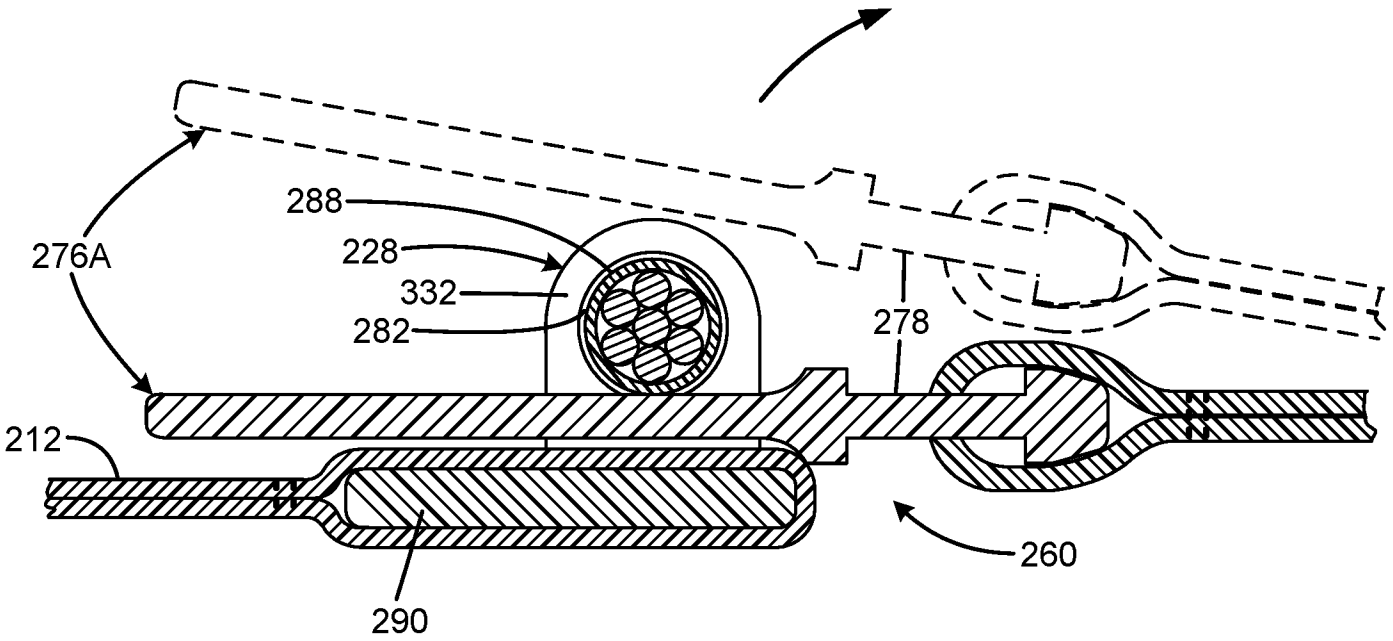
FIG. 23 is an enlarged top sectional view of the alternative embodiment of the right cummerbund of FIG. 15 in the attached condition with dashed lines depicting how the hooking device transitions to the detached condition after the quick-release cable is removed from the cable retainer.

Specifically, in FIG. 21, the operator 64 begins the emergency detach or egress procedure by grasping the quick-release pull tab 240A with one hand 66. The operator then uses the quick-release pull tab to pull the midpoint 238 of the quick-release cable 216 downwards to withdraw the ends 242, 244 of the cable from the cable end caps 236A, 236B attached to the bottom of the cable retainers 228 (shown in FIG. 22). Once the exposed portions 288 of the quick-release cable are removed from gaps 286 between the cable retention portions, the hooks 276A and tabs 276B can flip laterally out of the way as conveyed by the dashed lines in FIG. 23 to disengage the cummerbunds 254, 256 from the front plate carrier 212.

Figure 24:
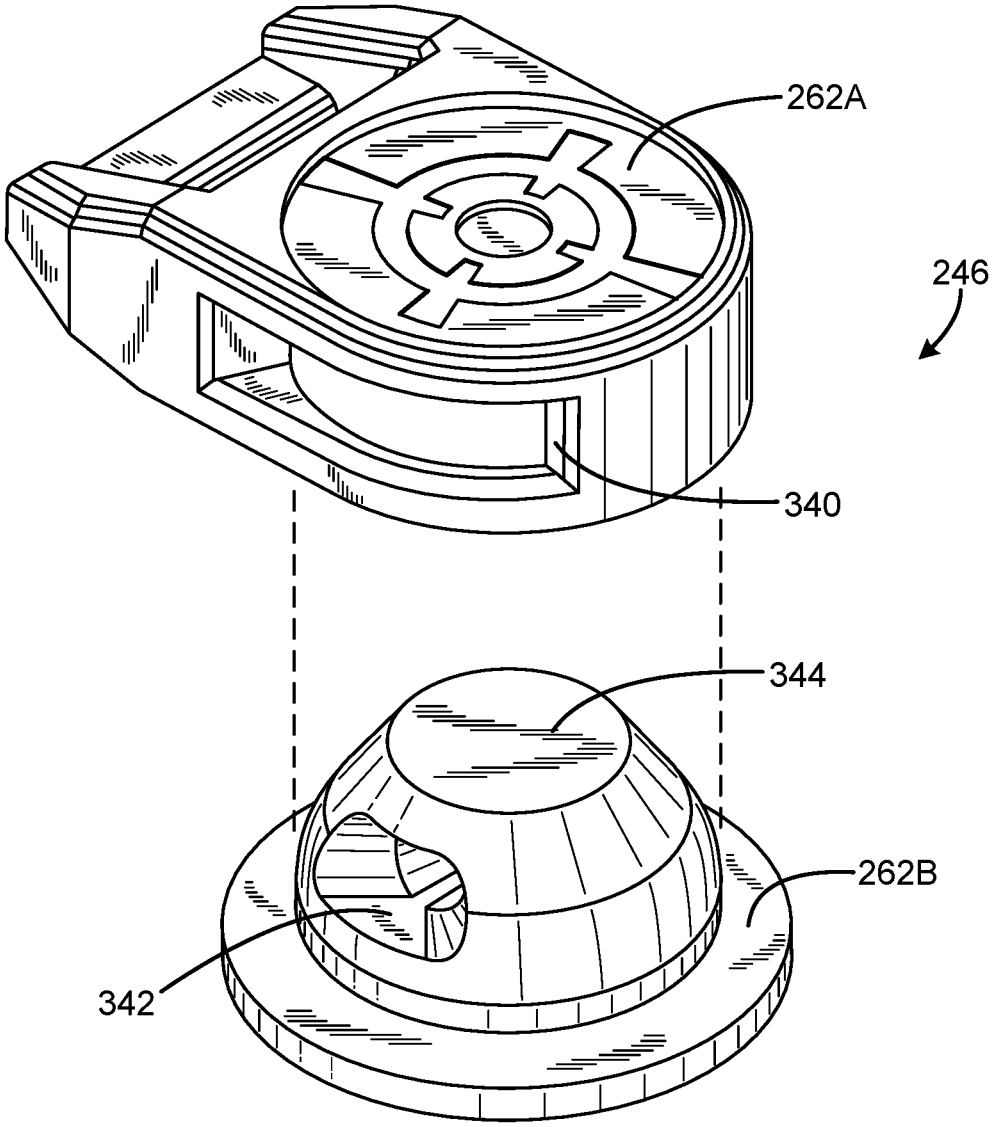
FIG. 24 is an isometric exploded view of the shoulder buckle removed from the utility garment of FIG. 15 with the shoulder buckle in the detached condition.

With continued pulling on the quick-release pull tab 240A, the operator 64 withdraws the ends 242, 244 of the quick-release cable 216 from the aperture 340 in the top buckle portion 262A and the aperture 342 in the bottom buckle portion 262B. With the cable withdrawn from both apertures, the weight of the front plate carrier 212 and rear plate carrier 214 causes the raised portion 344 of the bottom buckle portion to disengage from the top buckle portion as shown in FIG. 24. Since the cummerbunds 254 and 256 are already disengaged from the front plate carrier, the front plate carrier and rear plate carrier freely detach from the operator and fall off.

Figure 25:
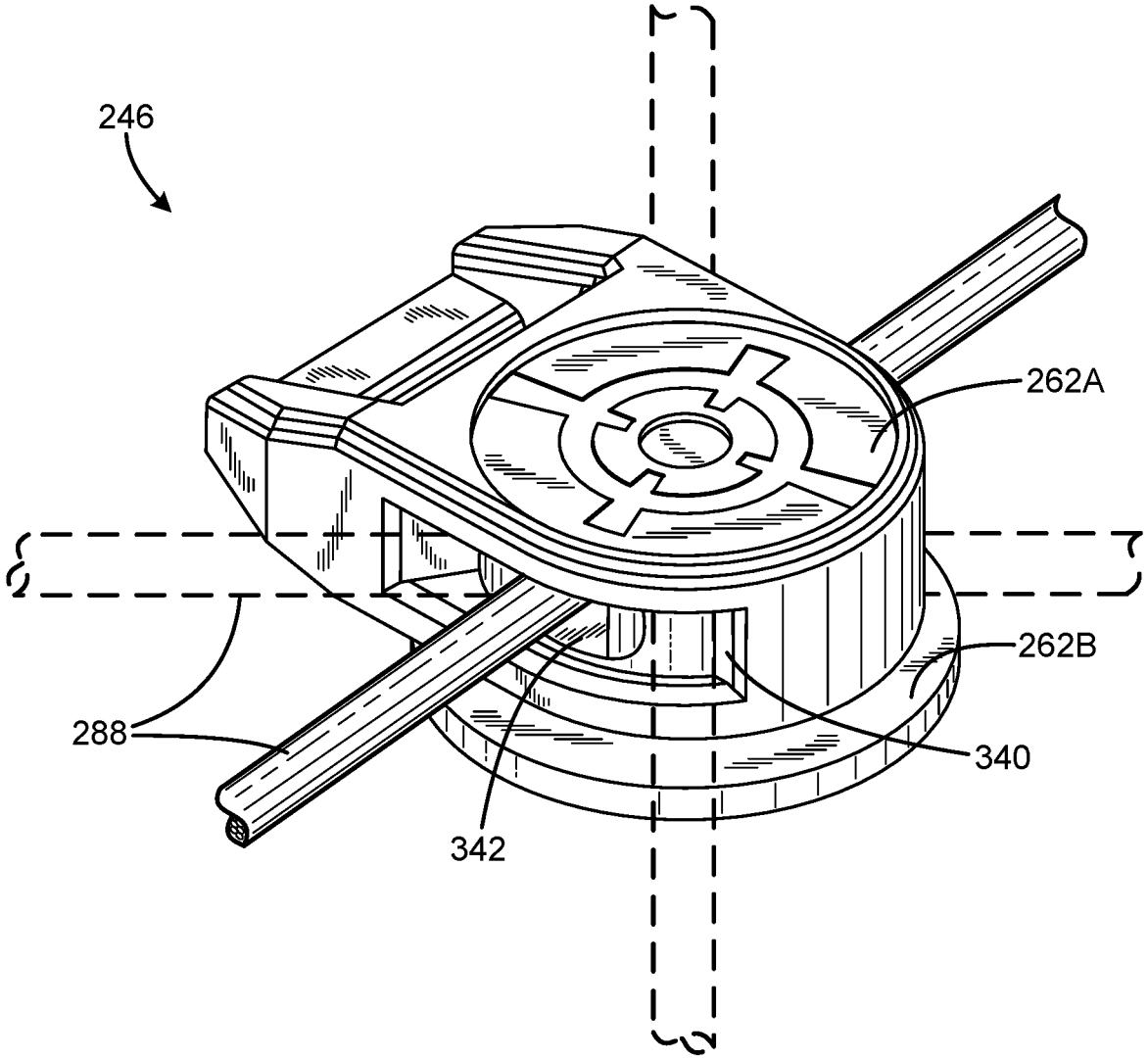
FIG. 25 is an isometric view of the shoulder buckle removed from the utility garment of FIG. 15 with dashed lines depicting the range of motion of the shoulder buckle when the quick-release cable is routed through the shoulder buckle.

FIG. 25 illustrates how the bottom buckle portion 262B has a considerable range of pivotal motion relative to the top buckle portion 262A to facilitate insertion of the ends 242, 244 of the quick-release cable 216 through apertures 340, 342 in the buckle portions and into the cable pockets 232, 234. More particularly, the apertures 340, 342 are both flared so the cable can turn a corner through them and occupy positions as extreme as those denoted by the dashed lines as the cable transitions from a horizontal orientation beneath the cable flap 230 to a vertical orientation within the cable pockets and the cable retainers 228.

The front garment portion and rear garment portion are removably detachable at a plurality of attachment facilities (hooking devices 260, top buckle portions 262A, lower buckle portions 262B, and cable retainers 228). Each attachment facility including a front facility portion connected to the front garment portion and a rear facility portion connected to the rear garment portion. At least a first one of the front facility portion and the rear facility portion have first and second bodies (cable retention portions 284). The first body defines a first cable passage and the second body defines a second cable passage (central apertures 282). The first cable passage and the second cable passage are registered with each other (shown in FIG. 17) and adapted to receive a single quick-release cable 216. The first body and second body are spaced apart from each other to define a latch receptacle space (gap 286). The first body and second body have opposed end surfaces (ends 332, 334) facing the latch receptacle space. A base element (bar 290) is connected between the bodies and spaced apart from a cable path defined by the location of the cable received in the first and second passages. At least a second one of the front facility portion and the rear facility portion includes a latch element (hooking devices 260) is adapted to be removably received in the latch receptacle space. The latch element has a flexible retention element (hook 276A) having an unflexed condition and a flexed condition. The retention element is adapted to contact at least one of the bodies to prevent extraction of the latch element from the latch receptacle when the cable occupies the first and second passages and the retention element is in the unflexed condition (shown in FIG. 17). The retention element is adapted to bypass at least one of the bodies to enable extraction of the latch element from the latch receptacle when a cable occupies the first and second passages and the retention element is in the flexed condition (shown in FIG. 20). The retention element is adapted to bypass at least one of the bodies to enable extraction of the latch element from the latch receptacle when the first and second passages are free of a cable and the retention element is in the unflexed condition (shown in FIGS. 22 & 23).

In the current embodiment, the latch element (hooking device 260) is a planar body having a thickness adapted to be closely received between the cable path and the base element (bar 290). The latch element has a fixed portion (tab 276B) adapted to contact one of the first and second bodies (cable retention portions 284) as the retention element contacts the other of the first and second bodies. The first and second passages (central apertures 282) are coaxial. A third body (cable retention portion 284) defines a third cable passage (central aperture 282) and defines a second latch receptacle space (gap 286) with the second body, and a second retention element (hook 276A) spaced apart from the first retention element and adapted to be received in the second latch receptacle space while the first retention element is received in the latch receptacle space. The first and second bodies are elongated bodies. The first and second bodies are protrusions from a planar base (bars 278 and 290). The quick-release cable 216 is formed of a plurality of metal strands (shown in FIG. 23).

In the current embodiment, the quick-release cable 216 has a substantial stiffness such that the cable may readily be threaded through the passages (central apertures 282), the stiffness being greater than a selected threshold to resist buckling in response to an axial compression force of one pound applied at two points spaced apart by five times the width of the cable. The cable is flexible to form a bend of at least 180° over its length. The cable has opposed free end portions 242, 244, and a central grasping portion (quick-release pull tab 240A), and wherein the garment supports the cable with the free ends spaced apart at a lower portion of the front panel, and the central grasping portion supported at an upper portion of the front panel at a midline of the panel (shown in FIG. 15). The front garment portion (front plate carrier 212) has a periphery of a selected periphery length, and the cable has a length less than the periphery length. The cable has a length of less than six feet, such that a typical adult wearer/operator 64 may fully extract the cable from the attachment facilities by grasping the midpoint of the cable and extending the midpoint of the cable to full arm's length away from the utility garment.

The latch element (hooking device 260) is formed of a resilient material. The utility garment 10 includes at least two attachment facilities (hooking devices 260 and cable retainers 228), each on opposed lower lateral side portions of the front and rear garment portions to encompass the torso of a wearer. The utility garment includes four attachment facilities, including one positioned at each shoulder of the garment (top buckle portions 262A and lower buckle portions 262B.

While current embodiments of a utility garment have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, a solid or integrated pin may be used with the cable retainer and retained by the hooks of the hooking device instead of the removable quick-release cable described. Furthermore, the hooking devices, cable retainers, and quick-release cable may be used to implement a front closure down a front midline instead of the shoulder and side closures described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A utility garment comprising:

a front garment portion configured for positioning at a wearer's chest;

a rear garment portion configured for positioning at a wearer's back;

the front garment portion and rear garment portion being removably detachable at a plurality of attachment facilities;

each attachment facility including a front facility portion connected to the front garment portion and a rear facility portion connected to the rear garment portion;

at least a first one of the front facility portion and the rear facility portion comprising first and second bodies;

the first body defining a first cable passage and the second body defining a second cable passage;

the first cable passage and the second cable passage being registered with each other and configured to receive a single cable;

the first body and second body being spaced apart from each other to define a latch receptacle space;

the first body and second body having opposed end surfaces facing the latch receptacle space;

a base element connected between the first and second bodies and spaced apart from a cable path defined by a location of the single cable when received in the first and second passages;

at least a second one of the front facility portion and the rear facility portion comprising a latch element configured to be removably received in the latch receptacle space;

the latch element having a retention element that is flexible having an unflexed condition and a flexed condition;

the retention element configured to contact at least one of the first and second bodies to prevent extraction of the latch element from the latch receptacle space when the single cable occupies the first and second passages and the retention element is in the unflexed condition;

the retention element configured to bypass the at least one of the first and second bodies to enable extraction of the latch element from the latch receptacle space in an extraction direction angularly offset from the first and second cable passages when the single cable occupies the first and second cable passages and the retention element is in the flexed condition;

the retention element configured to bypass the at least one of the first and second bodies to enable extraction of the latch element from the latch receptacle space when the first and second passages are free of the single cable and the retention element is in the unflexed condition; and the retention element having a raised step portion surface facing the extraction direction and being configured to engage at least one of the first and second bodies when the latch element is received in the latch receptacle space.

2. The utility garment of claim 1 wherein the latch element is a planar body having a thickness configured to be closely received between the cable path and the base element.

3. The utility garment of claim 1 wherein the latch element has a fixed portion configured to contact one of the first and second bodies as the retention element contacts the other of the first and second bodies.

4. The utility garment of claim 1 wherein the first and second passages are coaxial.

5. The utility garment of claim 1 wherein the retention element is a first retention element and the latch receptacle space is a first latch receptacle space, the utility garment including a third body defining a third cable passage and defining a second receptacle space with the second body, and a second retention element spaced apart from the first retention element and configured to be received in the second latch receptacle space while the first retention element is received in the first latch receptacle space.

6. The utility garment of claim 1 wherein the first and second bodies are elongated bodies.

7. The utility garment of claim 1 wherein the first and second bodies are protrusions from a planar base.

8. The utility garment of claim 1 including a cable formed of a plurality of metal strands.

9. The utility garment of claim 8 wherein the cable has a substantial stiffness such that the cable is configured to readily be threaded through the passages, the stiffness being greater than a selected threshold to resist buckling in response to an axial compression force of one pound applied at two points spaced apart by five times the width of the cable.

10. The utility garment of claim 8 wherein the cable is flexible to form a bend of at least 180° over its length.

11. The utility garment of claim 1 wherein the latch element is formed of a resilient material.

12. The utility garment of claim 1 including at least two attachment facilities, each on opposed lower lateral side portions of the front and rear garment portions to encompass the torso of a wearer.

13. The utility garment of claim 12 including four attachment facilities, including one positioned at each shoulder of the garment.

14. The utility garment of claim 1 where at least one of the attachment facilities is positioned at a shoulder portion of the garment.

15. The utility garment of claim 8 wherein the cable has opposed free end portions, and a central grasping portion, and wherein the garment supports the cable with the free ends spaced apart at a lower portion of the front panel, and the central grasping portion supported at an upper portion of the front panel at a midline of the panel.

16. The utility garment of claim 8 wherein the front garment portion has a periphery of a selected periphery length, and wherein the cable has a length less than the periphery length.

17. The utility garment of claim 8 wherein the cable has a length of less than six feet, such that the cable is configured to be fully extracted from the attachment facilities by an adult wearer grasping a midpoint of the cable and extending the midpoint of the cable to full arm's length away from the utility garment.

18. The utility garment of claim 1 wherein the utility garment is loadbearing.

19. The utility garment of claim 1 wherein the utility garment removably secures armor components to a wearer.

* * * * *